US008261842B2

(12) United States Patent
Moeller

(10) Patent No.: US 8,261,842 B2
(45) Date of Patent: Sep. 11, 2012

(54) EXPANDABLE WELLBORE LINER SYSTEM

(75) Inventor: Daniel Keith Moeller, Celina, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 316 days.

(21) Appl. No.: 12/633,561

(22) Filed: Dec. 8, 2009

(65) Prior Publication Data

US 2011/0132623 A1 Jun. 9, 2011

(51) Int. Cl.
*E21B 23/00* (2006.01)

(52) U.S. Cl. ..... 166/380; 166/382; 166/207

(58) Field of Classification Search ..... 166/206, 166/207, 380, 382, 384
See application file for complete search history.

(56) References Cited

U.S. PATENT DOCUMENTS

| | | | |
|---|---|---|---|
| 1,336,738 | A | 4/1920 | Fletcher |
| 2,011,036 | A | 8/1935 | Colmerauer |
| 2,214,226 | A | 9/1940 | English |
| 2,812,025 | A | 11/1957 | Teague et al. |
| 3,195,646 | A | 7/1965 | Brown |
| 3,203,451 | A | 8/1965 | Vincent |
| 3,219,116 | A | 11/1965 | Matthews, Jr. |
| 3,477,506 | A | 11/1969 | Malone |
| 3,598,184 | A | 8/1971 | Schuh |
| 3,785,193 | A | 1/1974 | Kinley et al. |
| 3,818,734 | A | 6/1974 | Bateman |
| 3,871,449 | A | 3/1975 | Ahlstone |
| 3,934,836 | A | 1/1976 | Dunlap et al. |
| 3,940,227 | A | 2/1976 | Strasser |
| 4,201,364 | A | 5/1980 | Taylor |
| 4,210,991 | A | 7/1980 | Cooper, Jr. |
| 4,212,186 | A | 7/1980 | Blattler |
| 4,251,176 | A | 2/1981 | Sizer et al. |
| 4,285,407 | A | 8/1981 | Samford |
| 4,388,971 | A | 6/1983 | Peterson |
| 4,391,325 | A | 7/1983 | Baker et al. |
| 4,415,029 | A | 11/1983 | Pratt et al. |
| 4,629,991 | A | 12/1986 | Wheeler |
| 4,681,168 | A | 7/1987 | Kisling, III |
| 4,754,543 | A | 7/1988 | Spivy |
| 4,848,469 | A | 7/1989 | Baugh et al. |
| 4,858,687 | A | 8/1989 | Watson et al. |
| 4,911,237 | A | 3/1990 | Melenyzer |

(Continued)

FOREIGN PATENT DOCUMENTS

EP 1223305 A2 7/2002

(Continued)

OTHER PUBLICATIONS

TIW Corporation, "TIW XPak Drill Down Liner System" downloaded from http://www.tiwtools.com on Nov. 23, 2009, file properties indicate 2005 creation (10 pages).

(Continued)

*Primary Examiner* — William P Neuder
*Assistant Examiner* — Richard Alker
(74) *Attorney, Agent, or Firm* — Fish & Richardson P.C.

(57) ABSTRACT

A setting tool has an expansion cone drive sub-assembly operable to axially move an expansion cone of the setting tool through the liner to radially, plastically expand the liner. With the wellbore liner residing outside of a wellbore, the setting tool is changed to enable decoupling the wellbore liner from the setting tool while leaving at least the expansion cone drive sub-assembly substantially assembled.

20 Claims, 13 Drawing Sheets

U.S. PATENT DOCUMENTS

| | | | |
|---|---|---|---|
| 4,926,936 | A | 5/1990 | Braddick |
| 5,070,940 | A | 12/1991 | Conner et al. |
| 5,070,941 | A | 12/1991 | Kilgore |
| 5,083,608 | A | 1/1992 | Abdrakhmanov et al. |
| 5,095,980 | A | 3/1992 | Watson |
| 5,112,158 | A | 5/1992 | McConnell |
| 5,127,472 | A | 7/1992 | Watson et al. |
| 5,264,162 | A | 11/1993 | Salem et al. |
| 5,318,131 | A | 6/1994 | Baker |
| 5,325,923 | A | 7/1994 | Surjaatmadja et al. |
| 5,327,765 | A | 7/1994 | Weykamp et al. |
| 5,352,526 | A | 10/1994 | Solanki et al. |
| 5,366,012 | A | 11/1994 | Lohbeck |
| 5,392,626 | A | 2/1995 | Blezard et al. |
| 5,396,957 | A | 3/1995 | Sujaatmadja et al. |
| 5,398,763 | A | 3/1995 | Watson et al. |
| 5,479,699 | A | 1/1996 | Snyder |
| 5,522,458 | A | 6/1996 | Watson et al. |
| 5,613,557 | A | 3/1997 | Blount et al. |
| 5,640,879 | A | 6/1997 | Damsohn et al. |
| 5,667,011 | A | 9/1997 | Gill et al. |
| 5,697,449 | A | 12/1997 | Hennig et al. |
| 5,746,557 | A | 5/1998 | Kaibach |
| 5,785,120 | A | 7/1998 | Smalley et al. |
| 5,823,031 | A | 10/1998 | Campbell et al. |
| 5,887,476 | A | 3/1999 | Damsohn et al. |
| 5,899,270 | A | 5/1999 | Watson |
| 5,901,789 | A | 5/1999 | Donnelly et al. |
| 6,012,522 | A | 1/2000 | Donnelly et al. |
| 6,012,523 | A | 1/2000 | Campbell et al. |
| 6,021,850 | A | 2/2000 | Wood et al. |
| 6,029,748 | A | 2/2000 | Forsyth et al. |
| 6,053,262 | A | 4/2000 | Ferguson et al. |
| 6,135,208 | A | 10/2000 | Gano et al. |
| 6,142,224 | A | 11/2000 | Stuebinger et al. |
| 6,173,768 | B1 | 1/2001 | Watson |
| 6,189,616 | B1 | 2/2001 | Gano et al. |
| 6,189,631 | B1 | 2/2001 | Sheshtawy |
| 6,241,018 | B1 | 6/2001 | Eriksen |
| 6,263,966 | B1 | 7/2001 | Haut et al. |
| 6,283,156 | B1 | 9/2001 | Motley |
| 6,325,148 | B1 | 12/2001 | Trahan et al. |
| 6,328,113 | B1 | 12/2001 | Cook |
| 6,334,351 | B1 | 1/2002 | Tsuchiya |
| 6,412,565 | B1 | 7/2002 | Castano-Mears |
| 6,415,509 | B1 | 7/2002 | Echols et al. |
| 6,450,261 | B1 | 9/2002 | Baugh |
| 6,457,518 | B1 | 10/2002 | Castano-Mears et al. |
| 6,457,533 | B1 | 10/2002 | Metcalfe |
| 6,467,547 | B2 | 10/2002 | Maguire et al. |
| 6,478,091 | B1 | 11/2002 | Gano |
| 6,478,092 | B2 | 11/2002 | Voll et al. |
| 6,530,574 | B1 | 3/2003 | Bailey et al. |
| 6,543,544 | B2 | 4/2003 | Schultz et al. |
| 6,543,545 | B1 | 4/2003 | Chatterji et al. |
| 6,561,271 | B2 | 5/2003 | Baugh et al. |
| 6,598,677 | B1 | 7/2003 | Baugh et al. |
| 6,631,765 | B2 | 10/2003 | Baugh et al. |
| 6,634,431 | B2 | 10/2003 | Cook et al. |
| 6,648,075 | B2 | 11/2003 | Badrak et al. |
| 6,648,076 | B2 | 11/2003 | Broome |
| 6,672,382 | B2 | 1/2004 | Schultz et al. |
| 6,688,397 | B2 | 2/2004 | McClurkin et al. |
| 6,695,050 | B2 | 2/2004 | Winslow et al. |
| 6,695,051 | B2 | 2/2004 | Smith et al. |
| 6,712,154 | B2 | 3/2004 | Cook et al. |
| 6,719,064 | B2 | 4/2004 | Price-Smith et al. |
| 6,722,427 | B2 | 4/2004 | Gano et al. |
| 6,722,433 | B2 | 4/2004 | Brothers et al. |
| 6,725,918 | B2 | 4/2004 | Gano |
| 6,725,934 | B2 | 4/2004 | Coronado et al. |
| 6,745,845 | B2 | 6/2004 | Cook et al. |
| 6,766,862 | B2 | 7/2004 | Chatterji et al. |
| 6,772,841 | B2 | 8/2004 | Gano |
| 6,799,635 | B2 | 10/2004 | Schultz et al. |
| 6,817,421 | B2 | 11/2004 | Dallas |
| 6,848,503 | B2 | 2/2005 | Schultz et al. |
| 6,854,522 | B2 | 2/2005 | Brezinski et al. |
| 6,857,486 | B2 | 2/2005 | Chitwood et al. |
| 6,915,852 | B2 | 7/2005 | Baugh et al. |
| 6,920,934 | B2 | 7/2005 | Badrak et al. |
| 6,941,652 | B2 | 9/2005 | Echols et al. |
| 6,994,170 | B2 | 2/2006 | Echols |
| 7,011,162 | B2 | 3/2006 | Maguire |
| 7,028,780 | B2 * | 4/2006 | Maguire ..... 166/382 |
| 7,040,404 | B2 | 5/2006 | Brothers et al. |
| 7,048,048 | B2 | 5/2006 | Nguyen et al. |
| 7,048,065 | B2 | 5/2006 | Badrak et al. |
| 7,048,067 | B1 | 5/2006 | Cook et al. |
| 7,055,598 | B2 | 6/2006 | Ross et al. |
| 7,077,211 | B2 | 7/2006 | Cook et al. |
| 7,108,062 | B2 | 9/2006 | Castano-Mears et al. |
| 7,114,559 | B2 | 10/2006 | Sonnier et al. |
| 7,124,829 | B2 | 10/2006 | Braddick |
| 7,128,147 | B2 | 10/2006 | Marcin et al. |
| 7,152,684 | B2 | 12/2006 | Harrall et al. |
| 7,152,687 | B2 | 12/2006 | Gano |
| 7,159,666 | B2 | 1/2007 | Nobileau |
| 7,165,608 | B2 | 1/2007 | Schultz et al. |
| 7,172,027 | B2 | 2/2007 | Simpson et al. |
| 7,182,141 | B2 | 2/2007 | Tran et al. |
| 7,204,316 | B2 | 4/2007 | Dusterhoft et al. |
| 7,213,647 | B2 | 5/2007 | Brothers et al. |
| 7,216,701 | B2 | 5/2007 | Cook et al. |
| 7,225,879 | B2 | 6/2007 | Wylie et al. |
| 7,225,880 | B2 | 6/2007 | Braddick |
| 7,234,532 | B2 | 6/2007 | Metcalfe et al. |
| 7,240,729 | B2 | 7/2007 | Cook et al. |
| 7,243,731 | B2 | 7/2007 | Watson et al. |
| 7,252,142 | B2 | 8/2007 | Brezinski et al. |
| 7,255,880 | B2 | 8/2007 | Bolton et al. |
| 7,264,047 | B2 | 9/2007 | Brezinski et al. |
| 7,275,598 | B2 | 10/2007 | Steele |
| 7,278,492 | B2 | 10/2007 | Braddick |
| 7,290,605 | B2 | 11/2007 | Waddell et al. |
| 7,299,882 | B2 | 11/2007 | Brezinski et al. |
| 7,320,367 | B2 | 1/2008 | Brezinski et al. |
| 7,363,986 | B2 | 4/2008 | Brezinski et al. |
| 7,383,889 | B2 | 6/2008 | Ring et al. |
| 7,404,437 | B2 | 7/2008 | Brezinski et al. |
| 7,419,009 | B2 * | 9/2008 | Cook et al. ..... 166/382 |
| 7,434,616 | B2 | 10/2008 | Echols |
| 7,441,606 | B2 | 10/2008 | Maguire |
| 7,513,313 | B2 | 4/2009 | Watson et al. |
| 7,546,881 | B2 | 6/2009 | Lloyd et al. |
| 7,559,365 | B2 | 7/2009 | Watson et al. |
| 2001/0045289 | A1 | 11/2001 | Cook et al. |
| 2001/0047866 | A1 | 12/2001 | Cook et al. |
| 2001/0047870 | A1 | 12/2001 | Cook et al. |
| 2002/0020524 | A1 | 2/2002 | Gano |
| 2002/0040787 | A1 | 4/2002 | Cook et al. |
| 2002/0046840 | A1 | 4/2002 | Schetky et al. |
| 2002/0050354 | A1 | 5/2002 | Schultz et al. |
| 2002/0050360 | A1 | 5/2002 | Cook et al. |
| 2002/0060068 | A1 | 5/2002 | Cook et al. |
| 2002/0060069 | A1 | 5/2002 | Cook et al. |
| 2002/0060078 | A1 | 5/2002 | Cook et al. |
| 2002/0074130 | A1 | 6/2002 | Cook et al. |
| 2002/0074134 | A1 | 6/2002 | Cook et al. |
| 2002/0079101 | A1 | 6/2002 | Baugh et al. |
| 2002/0084078 | A1 | 7/2002 | Cook et al. |
| 2002/0092648 | A1 | 7/2002 | Johnson et al. |
| 2002/0092657 | A1 | 7/2002 | Cook et al. |
| 2002/0092658 | A1 | 7/2002 | Johnson et al. |
| 2002/0108756 | A1 | 8/2002 | Harrall et al. |
| 2002/0121372 | A1 | 9/2002 | Cook et al. |
| 2002/0129935 | A1 | 9/2002 | Castano-Mears et al. |
| 2002/0139540 | A1 | 10/2002 | Lauritzen |
| 2002/0148612 | A1 | 10/2002 | Cook et al. |
| 2003/0019621 | A1 | 1/2003 | Schultz et al. |
| 2003/0047320 | A1 | 3/2003 | Badrak et al. |
| 2003/0111234 | A1 | 6/2003 | McClurkin et al. |
| 2003/0116328 | A1 | 6/2003 | Doane et al. |
| 2003/0131986 | A1 | 7/2003 | Schultz et al. |
| 2003/0141079 | A1 | 7/2003 | Doane et al. |
| 2003/0146003 | A1 | 8/2003 | Duggan et al. |
| 2003/0205386 | A1 | 11/2003 | Johnston et al. |

| | | | |
|---|---|---|---|
| 2003/0234102 | A1 | 12/2003 | Brothers et al. |
| 2004/0035578 | A1 | 2/2004 | Ross et al. |
| 2004/0035588 | A1 | 2/2004 | Doane et al. |
| 2004/0035590 | A1 | 2/2004 | Richard |
| 2004/0040703 | A1 | 3/2004 | Longmore |
| 2004/0055758 | A1 | 3/2004 | Brezinski et al. |
| 2004/0055759 | A1 | 3/2004 | Sivley, IV |
| 2004/0060695 | A1 | 4/2004 | Castano-Mears et al. |
| 2004/0060706 | A1 | 4/2004 | Stephenson |
| 2004/0065446 | A1 | 4/2004 | Tran et al. |
| 2004/0099423 | A1 | 5/2004 | Badrak et al. |
| 2004/0112609 | A1 | 6/2004 | Whanger et al. |
| 2004/0118572 | A1 | 6/2004 | Whanger et al. |
| 2004/0123983 | A1 | 7/2004 | Cook et al. |
| 2004/0168796 | A1 | 9/2004 | Baugh et al. |
| 2004/0182582 | A1 | 9/2004 | Bosma et al. |
| 2004/0194971 | A1 | 10/2004 | Thomson |
| 2004/0244982 | A1 | 12/2004 | Chitwood et al. |
| 2005/0015963 | A1 | 1/2005 | Costa et al. |
| 2005/0016738 | A1 | 1/2005 | Metcalfe et al. |
| 2005/0023003 | A1 | 2/2005 | Echols et al. |
| 2005/0028987 | A1 | 2/2005 | Watson et al. |
| 2005/0039916 | A1 | 2/2005 | Schultz et al. |
| 2005/0039921 | A1 | 2/2005 | Schultz et al. |
| 2005/0056433 | A1 | 3/2005 | Ring et al. |
| 2005/0056434 | A1 | 3/2005 | Watson et al. |
| 2005/0098324 | A1 | 5/2005 | Gano |
| 2005/0103502 | A1 | 5/2005 | Watson et al. |
| 2005/0183863 | A1 | 8/2005 | Cook et al. |
| 2005/0183864 | A1 | 8/2005 | Trinder et al. |
| 2005/0217866 | A1 | 10/2005 | Watson et al. |
| 2005/0230123 | A1 | 10/2005 | Waddell et al. |
| 2005/0236162 | A1 | 10/2005 | Badrak et al. |
| 2005/0263292 | A1 | 12/2005 | Braddick |
| 2005/0263294 | A1 | 12/2005 | Braddick |
| 2006/0032640 | A1 | 2/2006 | Costa et al. |
| 2006/0054330 | A1 | 3/2006 | Ring et al. |
| 2006/0065403 | A1 | 3/2006 | Watson et al. |
| 2006/0090902 | A1 | 5/2006 | Costa et al. |
| 2006/0090903 | A1 | 5/2006 | Gano et al. |
| 2006/0096762 | A1 | 5/2006 | Brisco |
| 2006/0137877 | A1 | 6/2006 | Watson et al. |
| 2006/0157257 | A1 | 7/2006 | Ross et al. |
| 2006/0162937 | A1 | 7/2006 | Costa et al. |
| 2006/0196679 | A1 | 9/2006 | Brisco et al. |
| 2006/0207760 | A1 | 9/2006 | Watson et al. |
| 2006/0225892 | A1 | 10/2006 | Watson et al. |
| 2006/0243444 | A1 | 11/2006 | Brisco et al. |
| 2006/0266527 | A1 | 11/2006 | Brisco et al. |
| 2006/0272826 | A1 | 12/2006 | Shuster et al. |
| 2007/0084367 | A1 | 4/2007 | Yoo et al. |
| 2007/0110927 | A1 | 5/2007 | Head et al. |
| 2007/0114016 | A1 | 5/2007 | Brezinski et al. |
| 2007/0114017 | A1 | 5/2007 | Brezinski et al. |
| 2007/0114018 | A1 | 5/2007 | Brezinski et al. |
| 2007/0114019 | A1 | 5/2007 | Brezinski et al. |
| 2007/0114044 | A1 | 5/2007 | Brezinski et al. |
| 2007/0144735 | A1 | 6/2007 | Lloyd et al. |
| 2007/0227730 | A1 | 10/2007 | Brisco et al. |
| 2007/0256829 | A9 | 11/2007 | Hosie et al. |
| 2007/0267201 | A1 | 11/2007 | Brezinski et al. |
| 2008/0000645 | A1 | 1/2008 | Brisco et al. |
| 2008/0035251 | A1 | 2/2008 | Brisco et al. |
| 2008/0066926 | A1 | 3/2008 | Costa et al. |
| 2008/0142229 | A1 | 6/2008 | Brisco et al. |
| 2008/0190616 | A1 | 8/2008 | Watson |
| 2008/0230234 | A9 | 9/2008 | Gano et al. |
| 2008/0236230 | A1 | 10/2008 | Brisco et al. |
| 2008/0251250 | A1 | 10/2008 | Brezinski et al. |
| 2008/0257542 | A1 | 10/2008 | Brisco et al. |
| 2008/0257560 | A1 | 10/2008 | Brisco et al. |
| 2009/0001721 | A1 | 1/2009 | Costa et al. |
| 2009/0107686 | A1 | 4/2009 | Watson |
| 2009/0193871 | A1 | 8/2009 | Brisco et al. |
| 2009/0200041 | A1 | 8/2009 | Watson |
| 2010/0155084 | A1 | 6/2010 | Watson et al. |
| 2011/0011320 | A1 | 1/2011 | Yemington |
| 2011/0132622 | A1 | 6/2011 | Moeller et al. |

FOREIGN PATENT DOCUMENTS

| | | | |
|---|---|---|---|
| EP | 1 717 411 | | 11/2006 |
| GB | 2 366 581 | A | 3/2002 |
| GB | 2 370 301 | A | 6/2002 |
| GB | 2 371 064 | A | 7/2002 |
| GB | 2 383 361 | A | 6/2003 |
| GB | 2 381 019 | A | 7/2003 |
| GB | 2 396 635 | A | 6/2004 |
| GB | 2 396 869 | A | 7/2004 |
| GB | 2 398 312 | A | 8/2004 |
| GB | 2 398 313 | A | 8/2004 |
| GB | 2 399 529 | A | 9/2004 |
| GB | 2 402 952 | | 12/2004 |
| GB | 2 412 394 | | 9/2005 |
| GB | 2 387 403 | B | 10/2005 |
| WO | WO 01/18353 | A1 | 3/2001 |
| WO | WO 02/28560 | A2 | 4/2002 |
| WO | WO 02/059452 | A1 | 8/2002 |
| WO | WO 03/023179 | A2 | 3/2003 |
| WO | WO 03/029609 | | 4/2003 |
| WO | WO 03/054349 | A1 | 7/2003 |
| WO | WO 03/058026 | | 7/2003 |
| WO | WO 03/060289 | | 7/2003 |
| WO | WO 2004/079157 | | 9/2004 |
| WO | WO 2006/052333 | | 5/2006 |

OTHER PUBLICATIONS

Baker Hughes, "INLine™ Liner Hanger Packer System" copyright 2006 (4 pages).

Halliburton, "Technical Marketing Document—VersaFlex Liner Systems" Jul. 2009 (26 pages).

Halliburton, "VersaFlex® Expandable Liner System" HES Completions Solutions Catalog, pp. 5-1-5-18, Dec. 2008.

Halliburton, "VersaFlex Liner Systems", brochure, Dec. 2007 (2 pages).

Halliburton, "VersaFlex Liner Hanger System", presentation, Sep. 2008 (19 pages).

Halliburton, "VersaFlex Liner Hanger System", presentation, Oct. 2008 (14 pages).

Baker Hughes, "Open Hole Completion Systems" Product Reference Guide, copyright 2004 (95 pages).

Baker Hughes, "TORXS™ New Generation Expandable Liner Hanger System", copyright 2008 (6 pages).

Mota, Jose; et al., "Drilling in with expandable liner hangers"; Expandables & Tubular Technology, Jun. 2006, (Total 2 pages).

Versaflex® Liner Hanger System [online]. Halliburton [retrieved on Oct. 10, 2007]. Retrieved from the Internet <URL: http://www.halliburton.com/ps/default.aspx?navid=110 &pageid=642prodgrpid=MSE%3A%3AIQTWQICZF> (Total 1 page).

VersaFlex® Liner Systems, Simplifying Liner Installation With Reliable Expandable Solutions. Halliburton Product Brochure, 2007. Available online at http://www.halliburton.com/public/cps/contents/Brochures/web/H05234.pdf. (Total 4 pages).

* cited by examiner

EXPANDABLE WELLBORE LINER SYSTEM

BACKGROUND

The present disclosure relates to wellbore liner systems incorporating expandable wellbore liners and to setting tools therefore.

An expandable wellbore liner is a type of wellbore liner that is intended to be radially, plastically deformed while in a wellbore. Such liners are often set in another tubular or against the interior wall of the wellbore by radially, plastically deforming the expandable liner into gripping and/or sealing engagement with the other tubular or the wall of the wellbore. For example, an expandable liner can be set near the foot of a casing and extend downhole into a wellbore, or hang other liners that extend downhole into the wellbore, to line an additional portion of the wellbore below the casing. In another example, an expandable liner can be set proximate a rupture, leak or otherwise weakened portion of a casing or liner as a repair measure to reinforce and/or seal the casing or liner.

Wellbore liners incorporating expandable liners are typically assembled to and carried into the wellbore on a setting tool. Thereafter, the setting tool is operated to radially, plastically expand the expandable liner. Due to the complexity of the setting tool, assembling the setting tool and assembling the expandable liner to the setting tool is a complex procedure involving many steps that must typically be performed in a certain sequence. If after assembly, a change is desired to be made to the setting tool or to the liner, the setting tool and liner must be disassembled in sequence (typically the reverse of the assembly sequence) to gain access to the aspect being changed. Because the assembly/disassembly must be performed in sequence, many aspects that are not affected by the change must still be disassembled to gain access to the aspect being changed and then reassembled.

SUMMARY

The present disclosure relates to wellbore liner systems incorporating expandable wellbore liners and to setting tools therefore.

An aspect encompasses a method of decoupling a wellbore liner from a setting tool. The setting tool has an expansion cone drive sub-assembly operable to axially move an expansion cone of the setting tool through the liner to radially, plastically expand the liner. In the method, with the wellbore liner residing outside of a wellbore, the setting tool is changed to enable decoupling the wellbore liner from the setting tool while leaving at least the expansion cone drive sub-assembly substantially assembled. The setting tool is then decoupled from the wellbore liner.

An aspect encompasses a method of assembling a wellbore liner to a setting tool. The setting tool being of the type for radially, plastically expanding the liner. In the method, with an expansion cone of the setting tool, expansion cone drive sub-assembly of the setting tool and liner latching member of the setting tool assembled, the wellbore liner is assembled to the setting tool. Then the liner latching member is engaged to the wellbore liner to couple the wellbore liner to the setting tool.

An aspect encompasses a setting tool for coupling to a wellbore liner and radially; plastically expanding the wellbore liner in a wellbore. The setting tool includes a tubular mandrel. A wellbore liner expander cone is carried on the tubular mandrel and operable to radially, plastically expand the liner when moved axially through in interior of the wellbore liner. An expander cone driving sub-assembly is carried on the tubular mandrel and operable to axially move the expander cone to expand the wellbore liner. A liner latching member is carried on the tubular mandrel and changeable, with the setting tool residing outside of the wellbore, from latched to unlatched from the wellbore liner without disassembling or operating the expander cone driving sub-assembly or disassembling the wellbore liner.

The aspects can include one, more than one or none of the following features. In certain instances, the setting tool can be changed to enable decoupling the wellbore liner from the setting tool while leaving a hydraulic chamber assembly, that is responsive hydraulic pressure to drive the expansion cone, substantially in tact to the setting tool. In certain instances, changing the setting tool to enable decoupling the setting tool from the liner includes changing the setting tool to allow a liner latching member of the setting tool to move radially inward. In certain instances, this can be accomplished by moving and/or removing a propping member that supports the latching member in engagement with the liner. In certain instances, the propping member can be removed from the setting tool comprises removing the propping member through a downhole end of the liner. In its substantially in tact or assembled state, the expansion cone driving sub-assembly of the setting tool is operable to axially move the expansion cone over its full axial travel. The wellbore liner can include a liner hanger and the setting tool can be operable to radially, plastically expand at least a portion of the liner hanger. The wellbore liner can be a single, unitary tubular member extending from end to end thereof.

The details of one or more embodiments are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Figure 1:
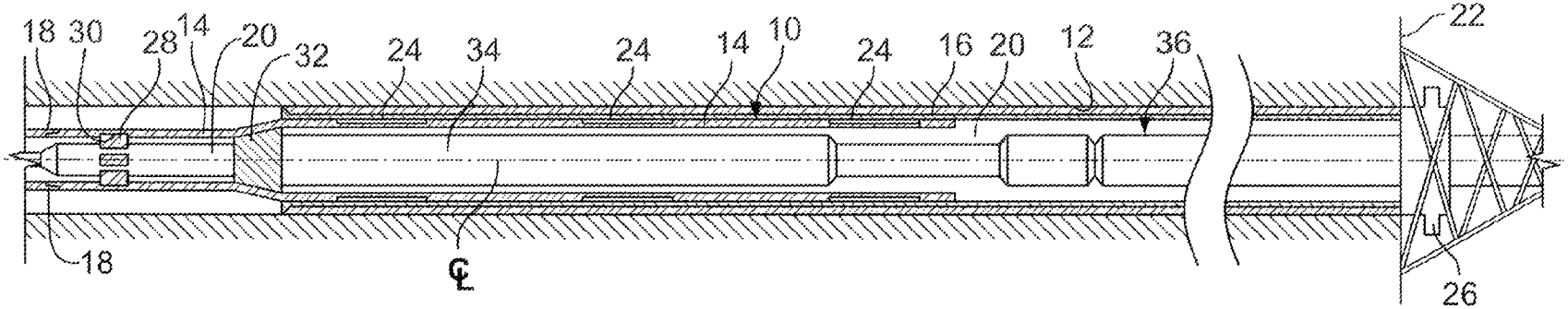
FIG. 1 is a view of an example liner system residing in a wellbore. For convenience of reference, "uphole" is toward the top of the figure and "downhole" is toward the bottom of the figure.

Referring first to FIG. 1, an example wellbore liner system 10 is shown residing in wellbore 12. The example liner system 10 includes an expandable wellbore liner called an expandable liner hanger 14 and a sub-assembly 18 of other liner components depending from the downhole end thereof. FIG. 1 shows the expandable liner hanger 14 having been radially, plastically deformed by a setting tool 20 so that its outer diameter continuously engages the interior diameter of the casing 16. In FIG. 1, the setting tool 20 is depicted as having been operated to deform the expandable liner hanger 14.

The wellbore 12 extends substantially vertically from a terranean surface 22 into the Earth. Although the wellbore 12 is depicted as being substantially vertical, in other instances, the entire wellbore or portions thereof may deviate to be slanted, curved substantially horizontal or otherwise non-vertical. Similarly, although the wellbore 12 is depicted as being a single wellbore, in other instances the wellbore can be a multilateral configuration having one or more lateral wellbores branching therefrom. The wellbore 12 provides access for injecting fluids into or withdrawing fluids from one or more subterranean zones of interest, where a subterranean zone of interest can correspond to a particular geological formation, can be a portion of a geological formation, or can include two or more geological formations. The casing 16 extends from a wellhead 26 at the surface 22 and through a portion of the wellbore 12. In certain instances, the casing 16 is cemented and/or otherwise affixed to the walls of the wellbore 12. In certain instances, the casing 16 is unapertured wall tubing.

The liner sub-assembly 18 can include one or more lengths of tubular liner, including unapertured wall tubing, slotted and/or apertured tubing, sand screen and/or other liner. If the liner sub-assembly 18 includes multiple lengths, the multiple lengths can be coupled together end to end (threadingly and/or otherwise) to define the liner sub-assembly 18. The liner sub-assembly 18 can also include other components, such as valves, seals, centralizers, and/or other components. In certain instances, the downhole end of the liner sub-assembly 18 can include provisions to attach to additional components (threadingly and/or otherwise). The downhole end of the expandable liner hanger 14 includes provisions to couple to the liner sub-assembly 18 (threadingly and/or otherwise).

The expandable liner hanger 14 is shown engaging the downhole end of the casing 16, such that the expandable liner hanger 14 and the liner sub-assembly 18 extend from the downhole end of the casing 16 further into the wellbore 12. In other instances, the expandable liner hanger 14 and liner sub-assembly 18 can be positioned elsewhere within the wellbore 12 and/or in other associated wellbores. For example, in the context of a casing repair, the expandable liner hanger 14 can be positioned uphole from a rupture, leakage, or otherwise weakened point in the casing 16. In another example, in the context of a multilateral, the expandable liner hanger 14 can be positioned proximate a lateral branch with the liner hanger extending into the lateral branch. Still further examples exist, and more than one liner hanger 14 and liner sub-assembly 18 can be provided in the wellbore 12.

In FIG. 1, the expandable liner hanger 14 includes one or more seals 24 (three shown) circumscribing the outer diameter of the expandable liner hanger 14. The seals 24 facilitate sealing between the expandable liner hanger 14 and the casing 16 when the outer diameter of the expandable liner hanger 14 engages the inner diameter of the casing 16. In certain instances, the seals 24 form a gas-tight seal between the expandable liner hanger 14 and the casing 16. In other instances, the seals 24 can be omitted.

The setting tool 20 is a component of a working string 36 that extends from the surface 22 into the wellbore 12. In addition to the setting tool 20, the working string 36 includes tubing (e.g., jointed tubing, continuous tubing without joints (e.g., coiled tubing), and/or other types of tubing) and/or other components. The setting tool 20 carries the expandable liner hanger 14 and liner sub-assembly 18 into the wellbore 12, and operates to radially, plastically deform the expandable liner hanger 14 into engagement with the casing 16. The setting tool 20 includes radially extendable and retractable latching lugs 28 used in coupling the setting tool 20 to the expandable liner hanger 14. FIG. 1 shows the setting tool 20 coupled to the expandable liner hanger 14, with lugs 28 radially extended into engagement with a profile 30 of the expandable liner hanger 14. When coupled to the expandable liner hanger 14, the lugs 28 can axially support the expandable liner hanger 14, the liner sub-assembly 18 and any additional components associated there with. In certain instances, the lugs 28 can additionally transmit torque between the setting tool 20 and the expandable liner hanger 14, for example, to enable the expandable liner hanger 14 and liner sub-assembly 18 to be rotated while in the wellbore 12. The setting tool 20 can be decoupled from the expandable liner hanger 14 by allowing the lugs 28 to radially retract out of engagement with the profile 30. Notably, setting tool 20 can be changed from having the lugs 28 extended to allowing the lugs to radially retract without having to operate the setting tool 20 radially, plastically expand the liner hanger 10.

The setting tool 20 includes an expansion cone 32 that when driven through the expandable liner hanger 14 radially, plastically deforms the expandable liner hanger 14 from a first, smaller outer diameter to a second, larger outer diameter. The setting tool 20 has an expansion cone driving sub-assembly 34 that drives the expansion cone 32 towards the lugs 28 in expanding the expandable liner hanger 14. In certain instances, the cone driving sub-assembly 34 can include hydraulic aspects having one or more pistons and cylinders that move the expansion cone 32 in response to hydraulic pressure, such as hydraulic pressure applied through the interior bore of the setting tool 20 and/or otherwise. In certain instances, the cone driving sub-assembly 34 move the expansion cone 32 in response to hydraulic pressure without use of pistons and cylinders. Some examples of hydraulic expansion cone driving sub-assemblies suitable for use herein can be seen in a U.S. patent application entitled "Setting tool for Expandable Liner Hanger and Associated Methods," Ser. No. 12/342,718, filed Dec. 23, 2008 and/or FIGS. 2A-J discussed below. In certain instances, the cone driving sub-assembly 34 can include mechanical aspects, for example, a power screw that moves the expansion cone when the power screw is rotated via the working string 36. Still further examples of expansion cone driving sub-assembly 34 exist.

In the configuration of FIG. 1, the setting tool 20 drives the expansion cone 32 from a location about an uphole end of the expandable liner hanger 14, and distal from the lugs 28, axially toward a location about the downhole end of the expandable liner hanger 14, and proximate the lugs 28. In other instances, the setting tool 20 can be configured to operate in other manners, for example, to drive the expansion cone 32 from location about a downhole end of the expandable liner hanger 14 axially toward a location about the uphole end of the expandable liner hanger 14 and toward or away from the lugs 28.

In operation, the expandable liner hanger 14 and liner sub-assembly 18 are coupled to the setting tool 20. The expandable liner hanger 14 and liner sub-assembly 18 are then run into the wellbore on the setting tool 20 as part of the working string 36. The working string 36 is manipulated to locate the expandable liner hanger 14 to place the expandable liner hanger 14 at the location in which the expandable liner hanger 14 will be radially, plastically expanded (e.g., where the expandable liner hanger 14 will be expanded into engagement with the casing 16). The expansion cone driving sub-assembly 34 is then hydraulically actuated to drive the expansion cone 32 through the expandable liner hanger 14 and radially, plastically expand the expandable liner hanger 14 into engagement with the interior of the casing 16. When expansion of the expandable liner hanger 14 is complete, the lugs 28 are released to radially retract out of engagement with the profile 30 and the working string 36, including setting tool 20, is withdrawn from the wellbore 12.

Turning now to FIGS. 2A-2J and FIGS. 3A-3J, an exemplary setting tool 200 and liner hanger 210 are shown. The exemplary setting tool 200 and liner hanger 210 can be used in liner system 10 (discussed above), as setting tool 20 and liner hanger 14, respectively. FIGS. 2A-2J are successive detail side cross-sectional views of the exemplary setting tool 200 coupled to the liner hanger 210 as the setting tool 200 would be configured when carrying the liner hanger 210 (and liner sub-assembly 18) into the wellbore. FIGS. 3A-3J are successive detail side cross-sectional views of the exemplary setting tool 200 after having operated to radially, plastically expand the liner hanger 210.

The liner hanger 210 is tubular, and as with liner hanger 14, can have provisions at its downhole end to couple (threadingly and/or otherwise) to the liner sub-assembly 18. Also, in certain instances, the liner hanger 210 can be constructed as a single, unitary tubular member extending from end to end.

Although made up of a number of different subcomponents, the exemplary setting tool 200 is substantially tubular having a central bore 212 extending throughout. Similar to the setting tool 20 and liner hanger 14, discussed above, setting tool 200 includes latching lugs 220 (FIG. 2J) that engage a mating profile 222 (FIG. 2J) of the liner hanger 210 to couple and decouple the setting tool 200 with the liner hanger 210. The setting tool 200 also includes an expansion cone 250 (FIGS. 2H and 3I) that, when driven through the liner hanger 210, radially, plastically expands the liner hanger 210, and an expansion cone drive sub-assembly 270 (FIGS. 2B-2H and FIGS. 3C-3I) that operates to drive the expansion cone 250 through the liner hanger 210.

Figure 2A:
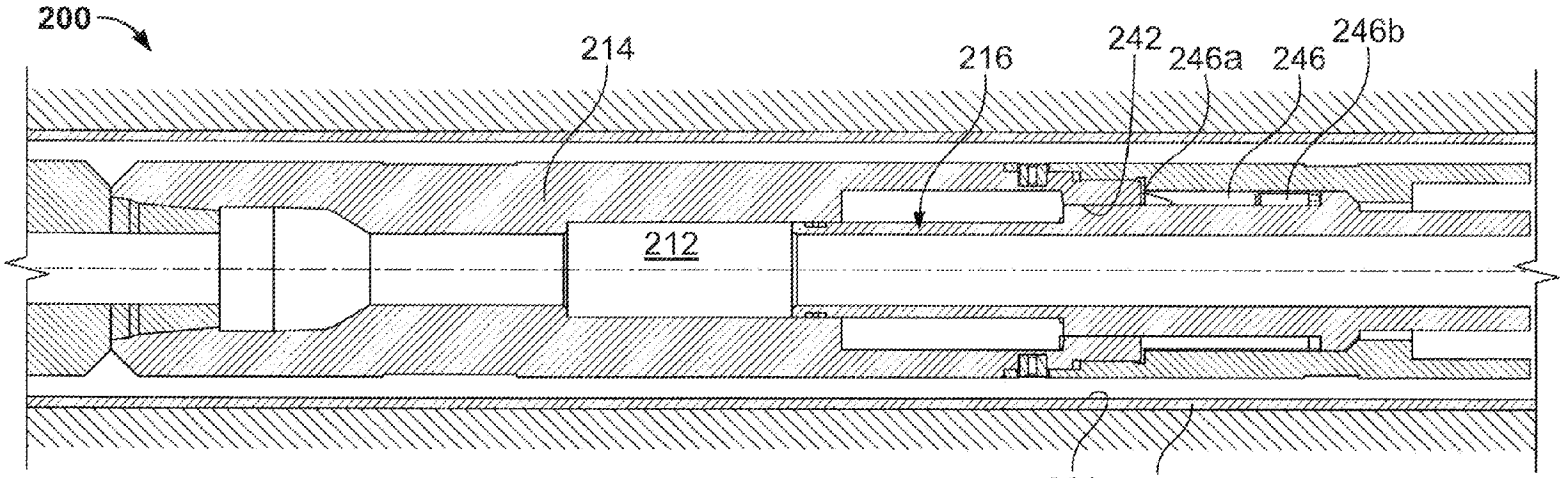
FIGS. 2A-2J are successive detail side cross-sectional views of an example setting tool coupled to a liner hanger as the setting tool would be configured when carrying the liner hanger into a wellbore. For convenience of reference, "uphole" is toward the left of the figure and downhole is toward the right of the figure.
Figure 3A:
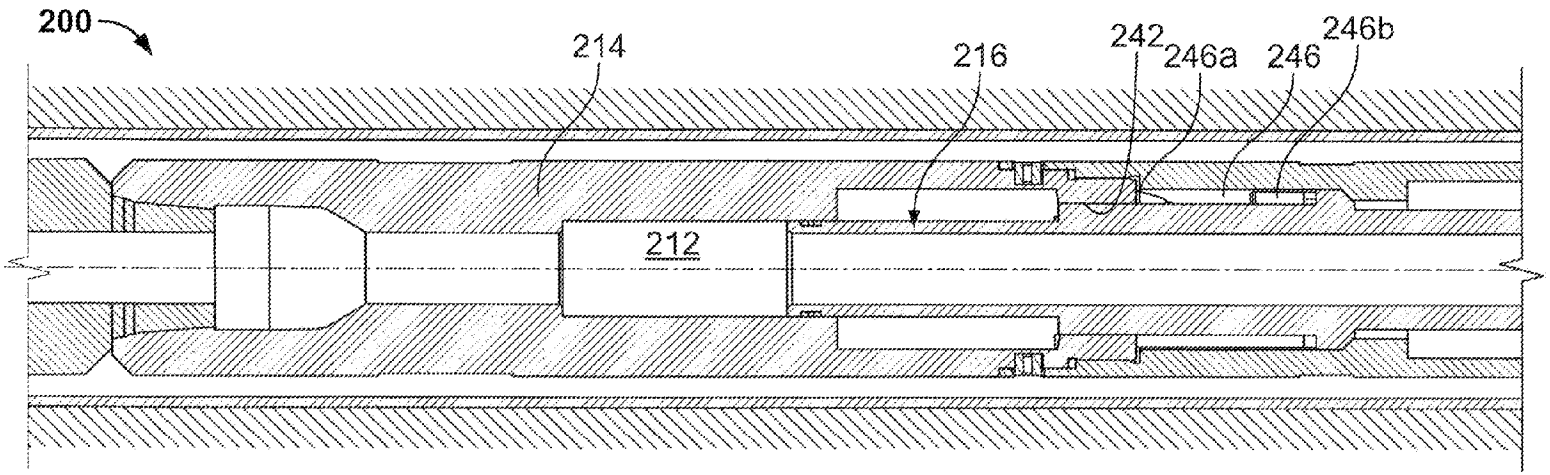
FIGS. 3A-3J are successive detail side cross-sectional views of the example setting tool of FIGS. 2A-2I after having operated to radially, plastically expand the liner hanger. For convenience of reference, "uphole" is toward the left of the figure and downhole is toward the right of the figure.

Referring first to FIG. 2A, the setting tool 200 includes a tubular upper body 214 at its uphole end. The upper body 214 has provisions at its uphole end to couple to other components (threadingly and/or otherwise), for example, other components of a working string used to carry the setting tool 200 into a wellbore and to manipulate the setting tool 200. The upper body 214 is coupled to an inner mandrel assembly 216 that extends substantially the remaining length of the tool 200 to a lower latch prop body 224, shown in FIG. 2J. The upper body 214, inner mandrel assembly 216 and latch prop body 224 define the central bore 212, and can be threadingly and/or otherwise coupled together. The lower latch prop body 224 has provisions at its downhole end to couple to other components (threadingly and/or otherwise), for example, other components of the working string. The latch prop body 224 is readily removable from the downhole end of the inner mandrel assembly 216. For example, if threadingly coupled, the latch prop body 224 can be unscrewed from the inner mandrel assembly 216.

Figure 2B:
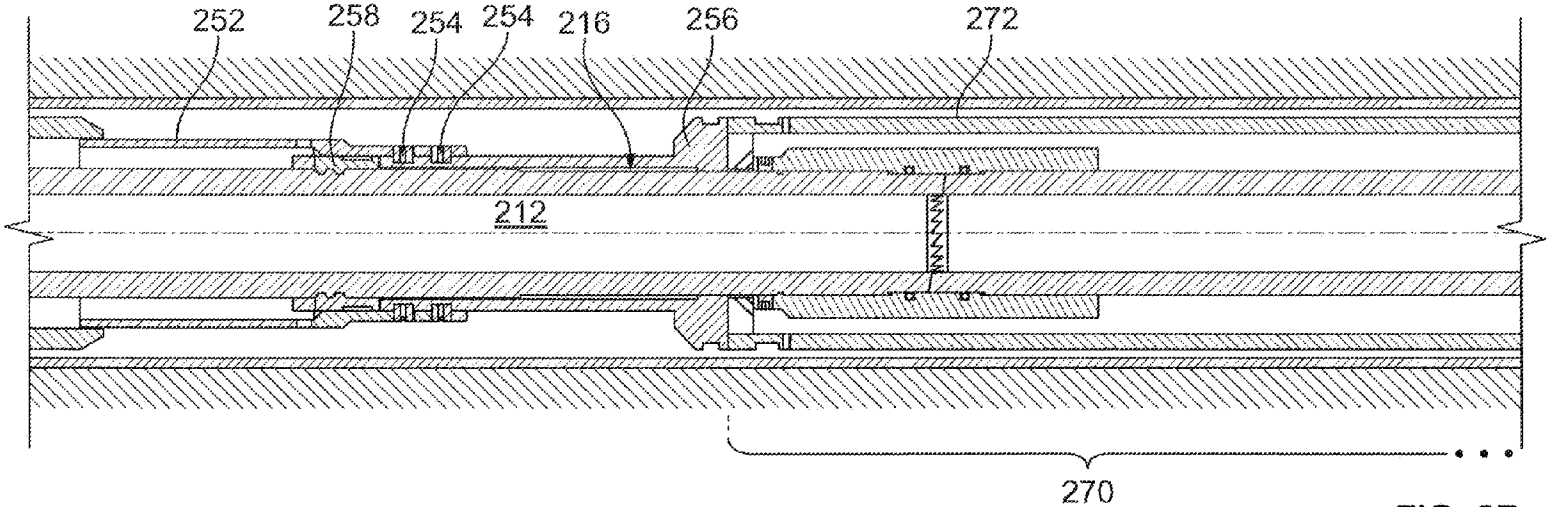
Figure 3B:
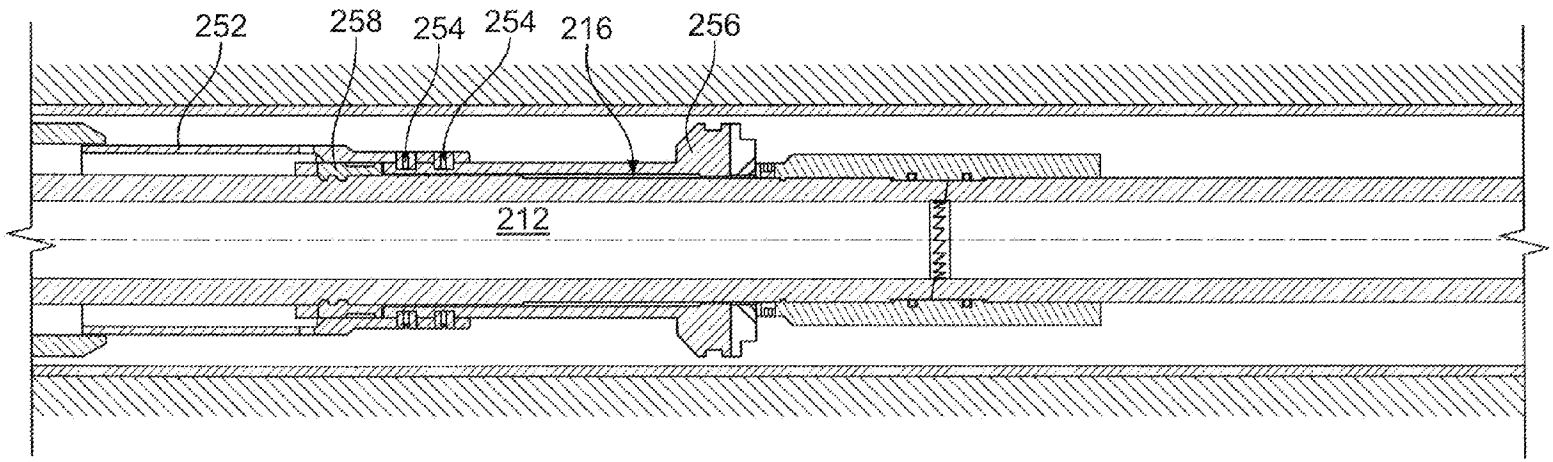
Figure 2C:
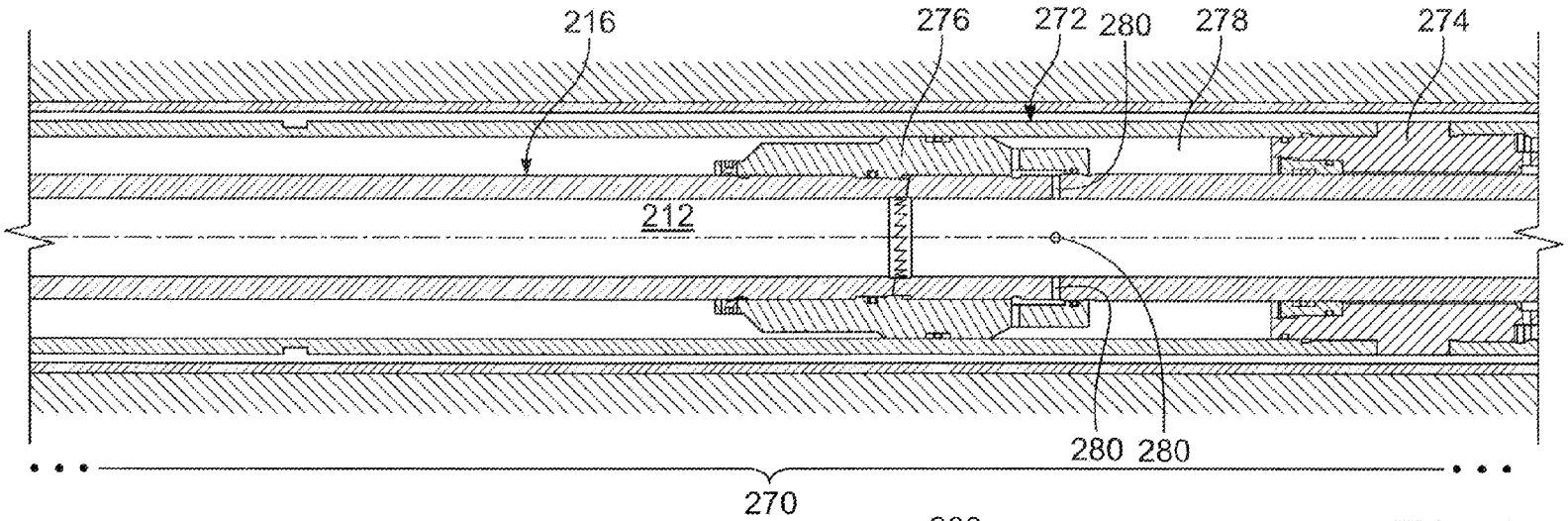
Figure 3C:
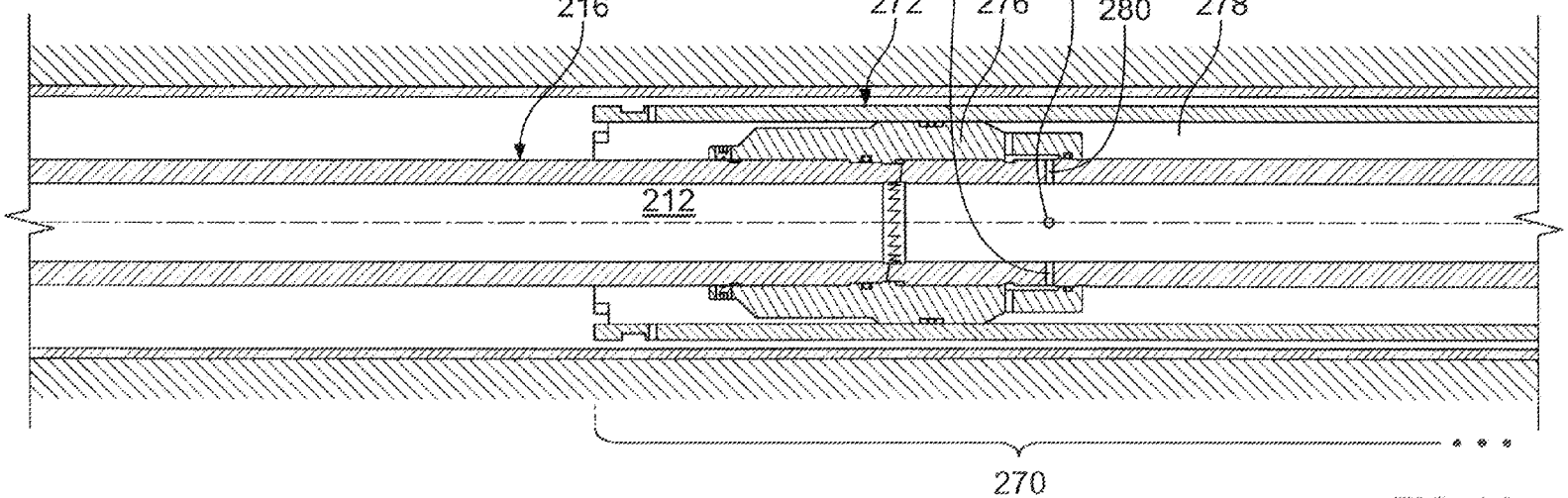
Figure 2D:
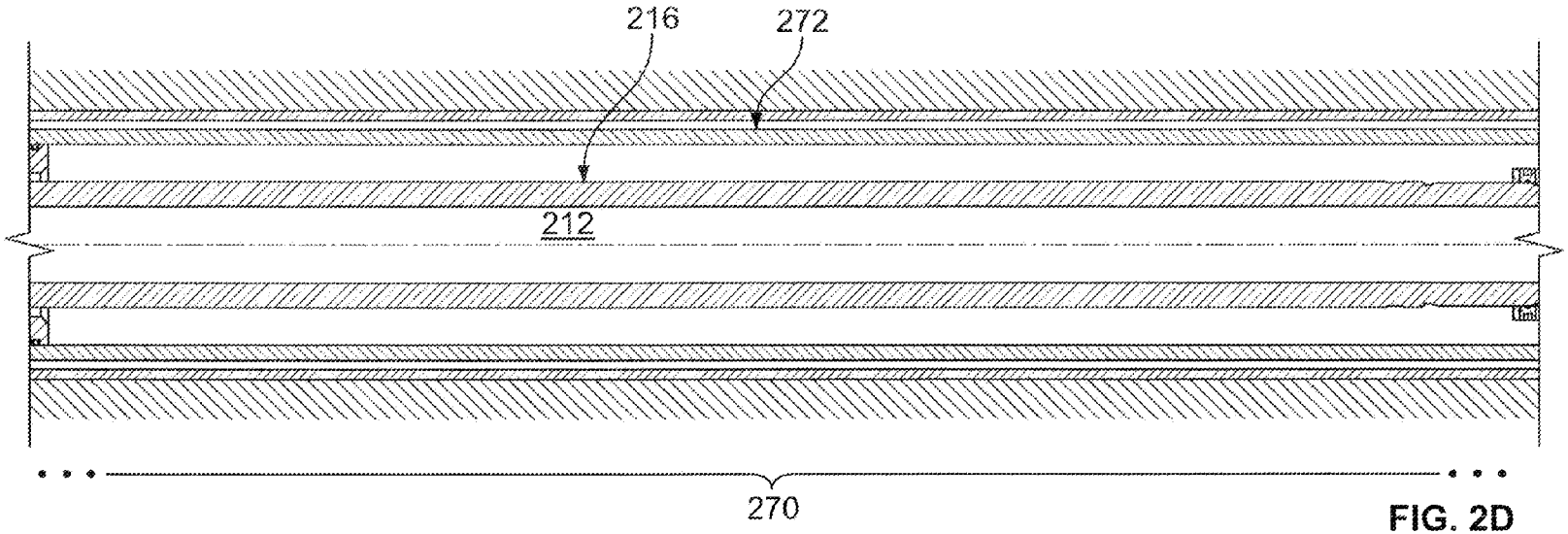
Figure 3D:
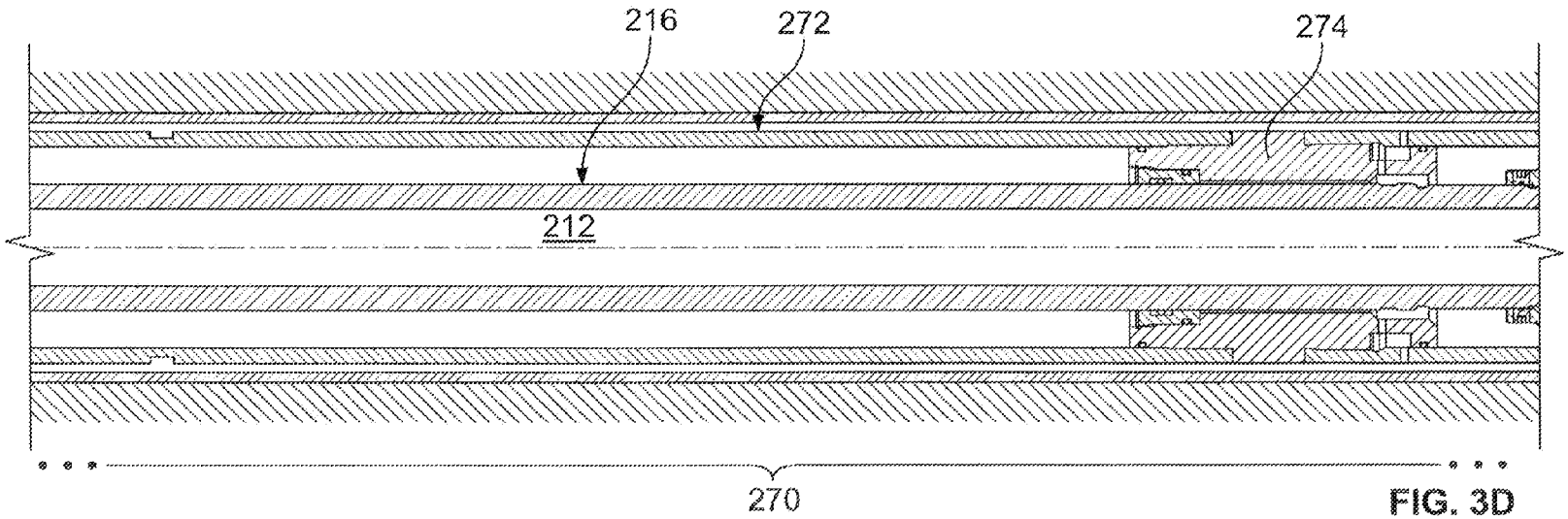
Figure 2E:
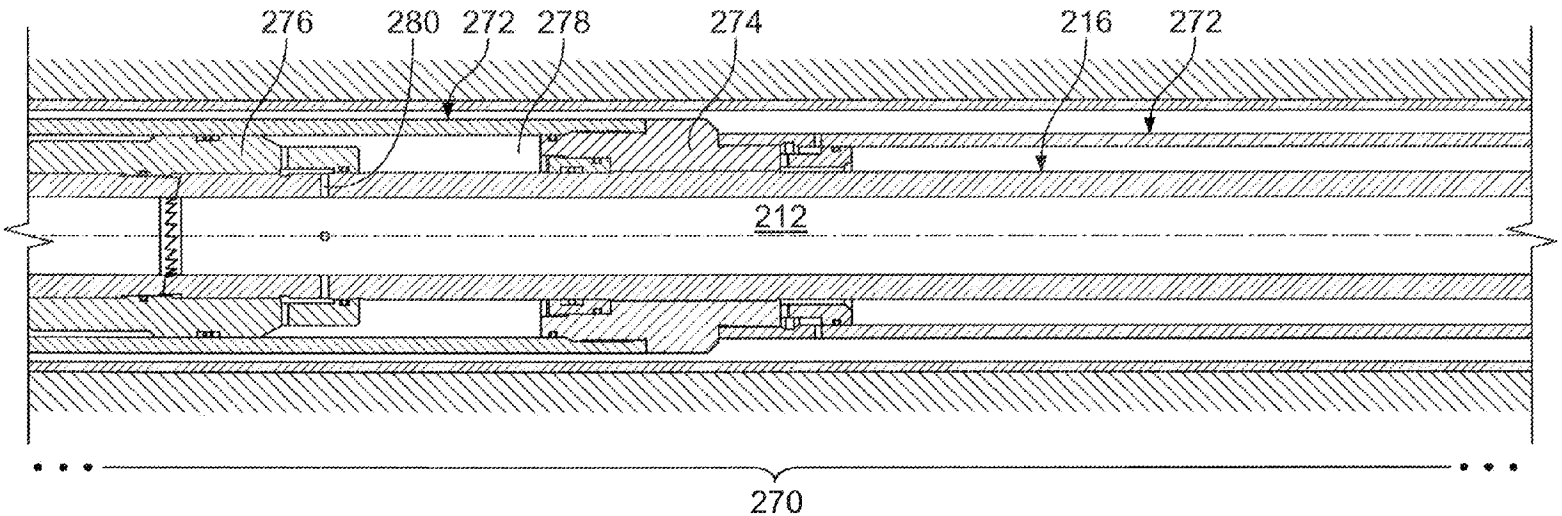
Figure 3E:
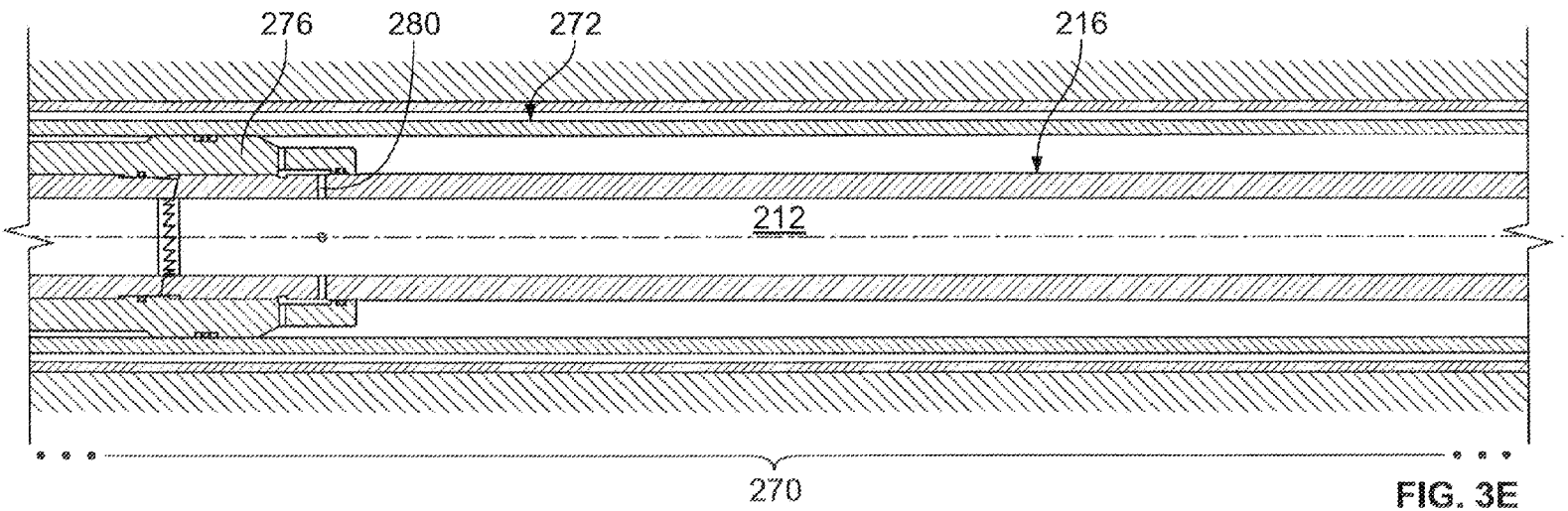
Figure 2F:
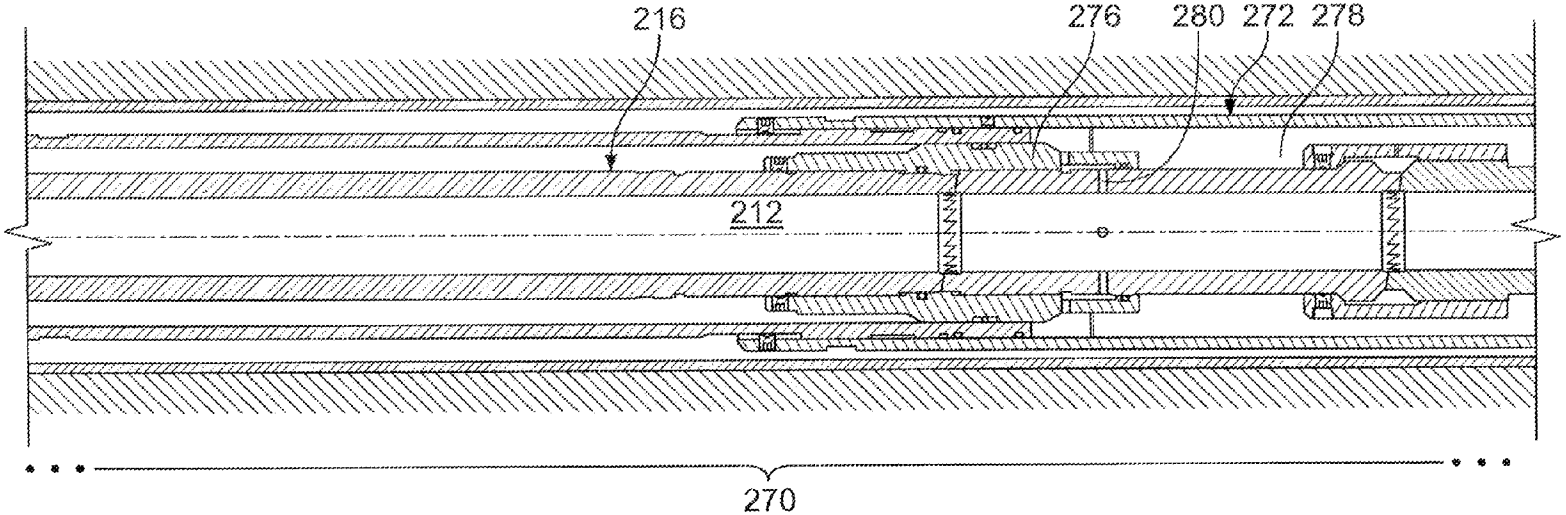
Figure 3F:
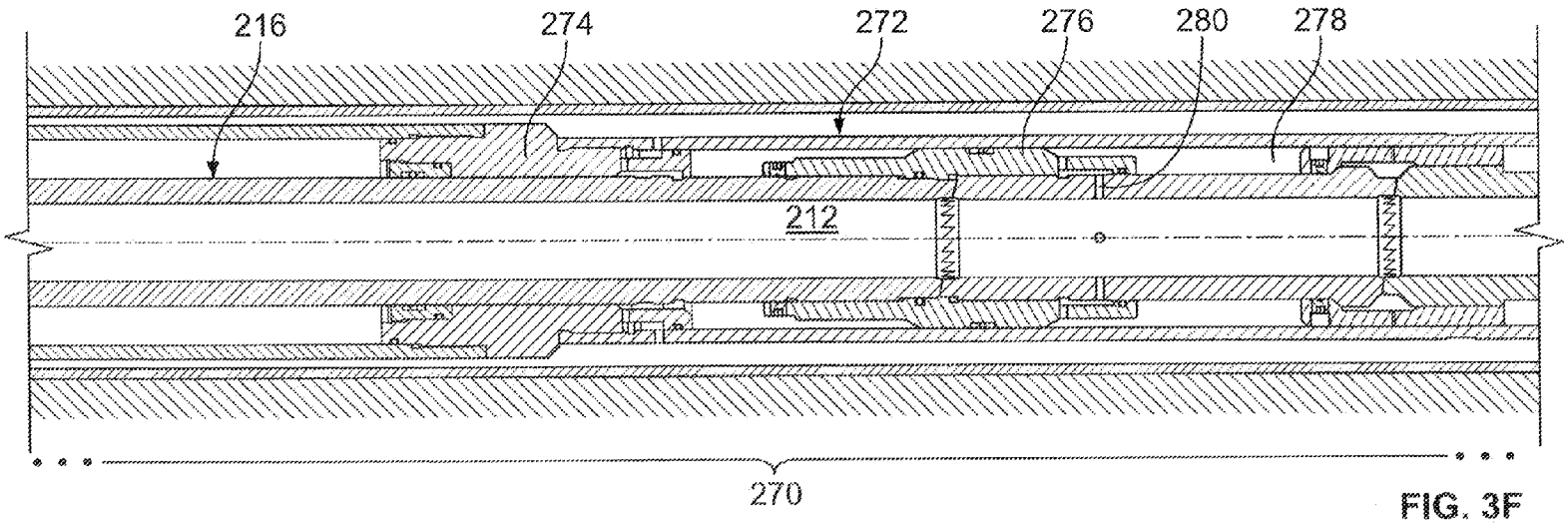
Figure 2G:
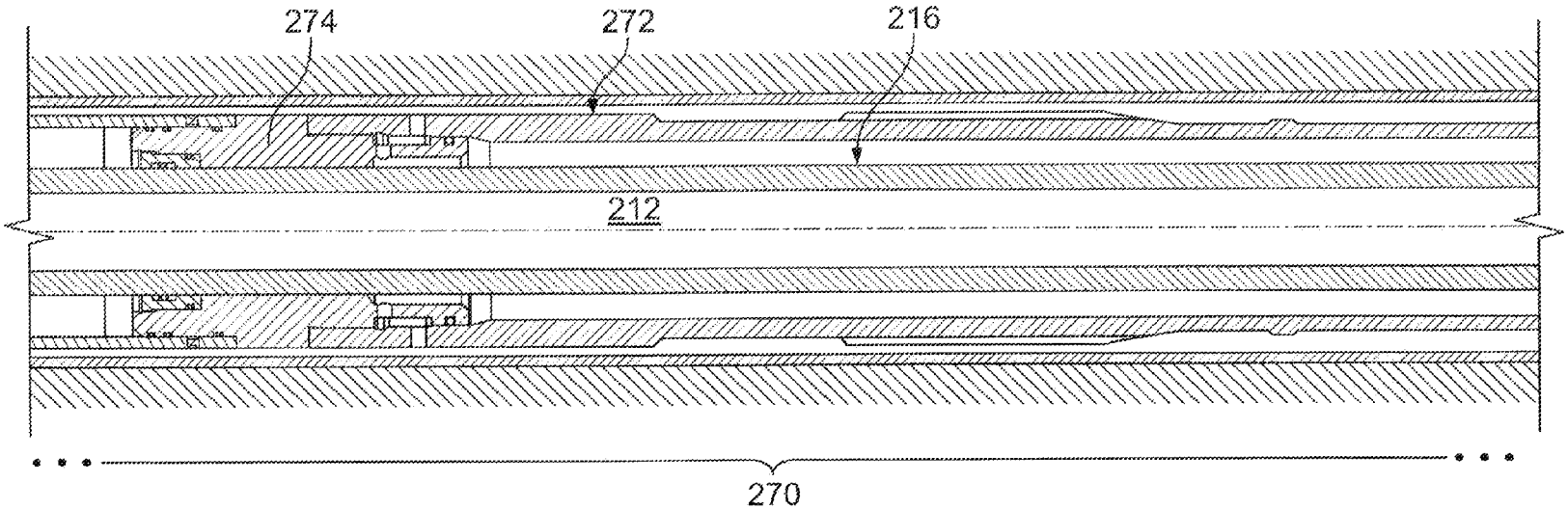
Figure 3G:
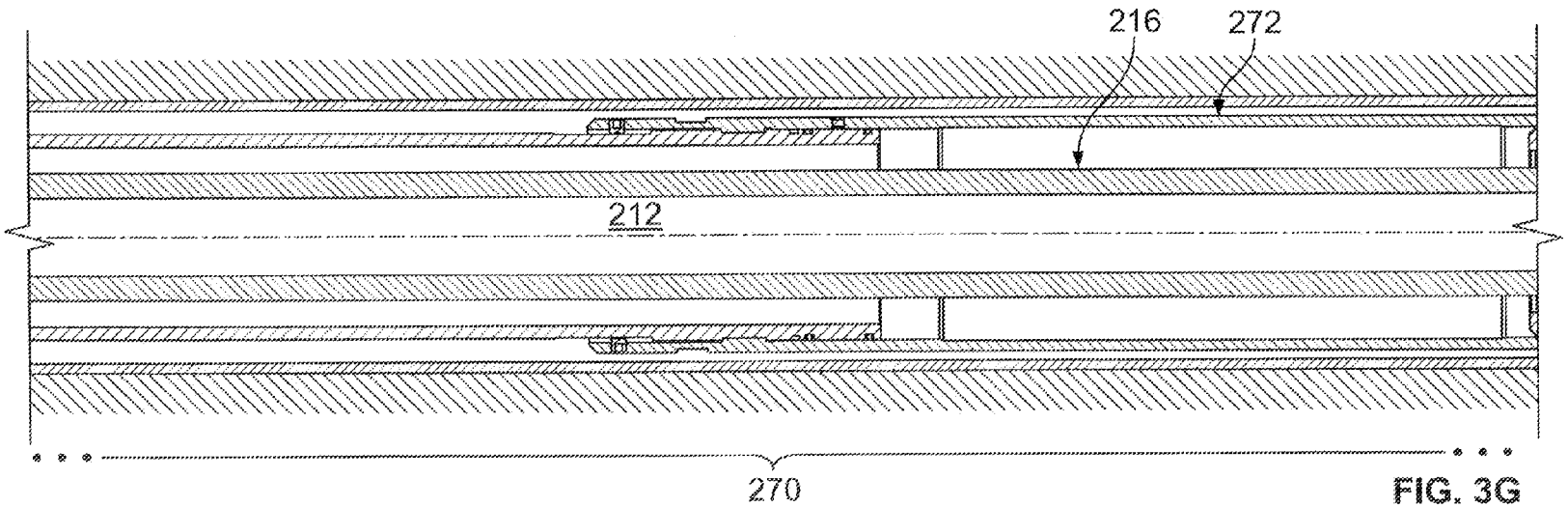
Figure 2H:
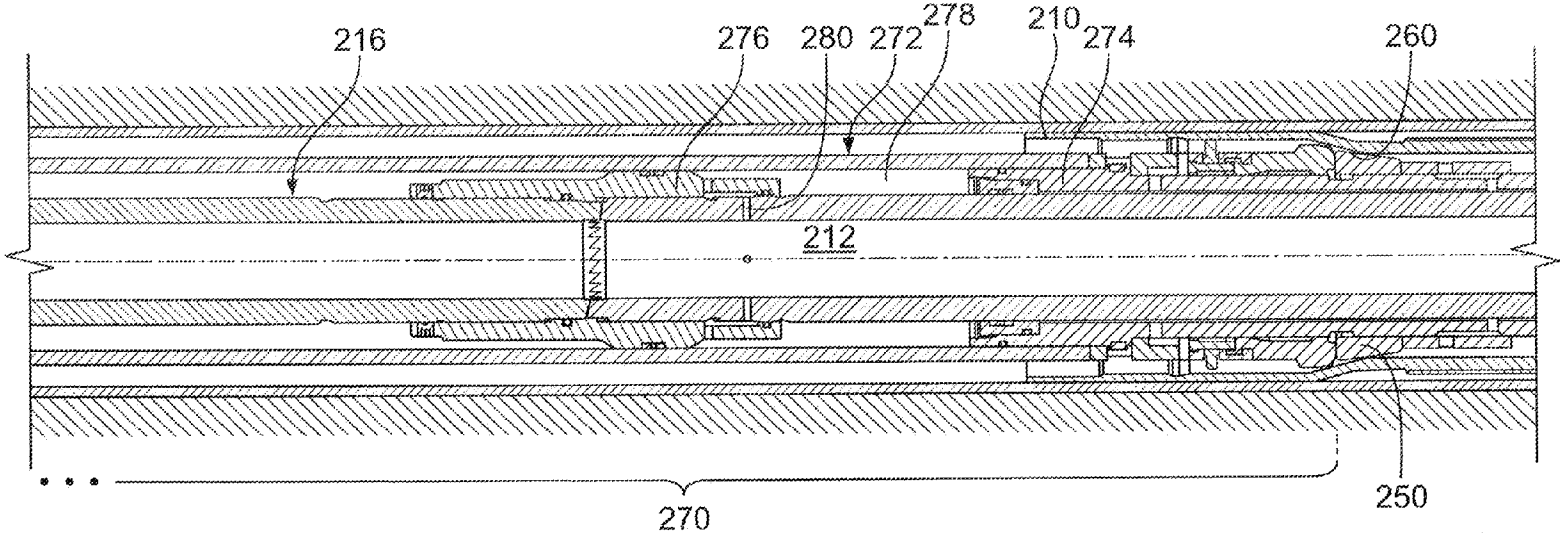
Figure 2I:
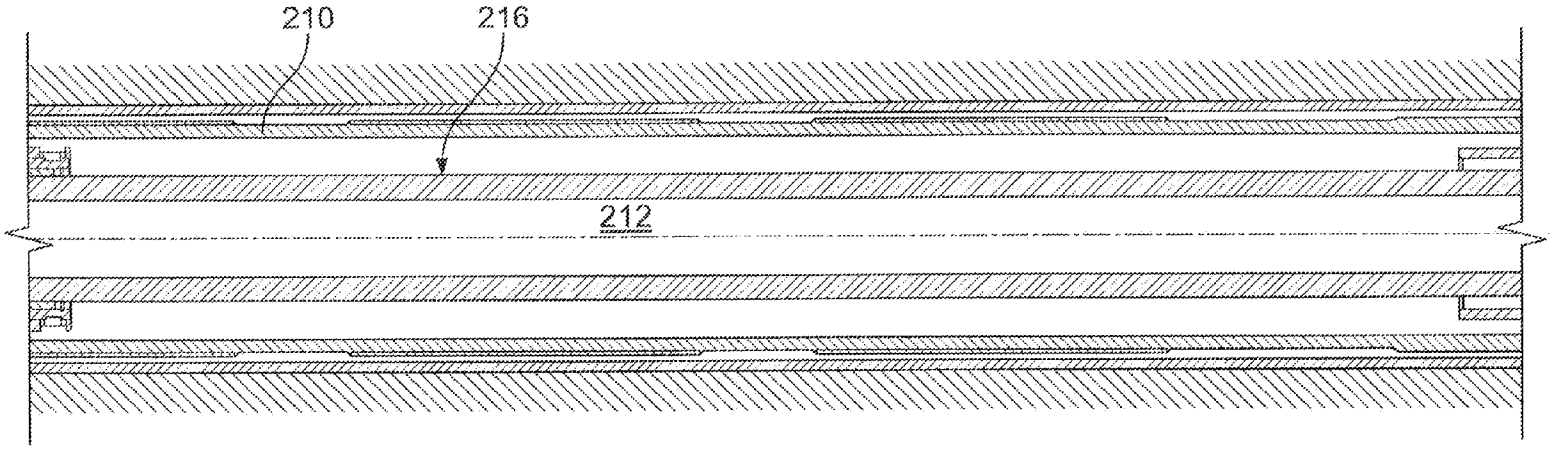
Figure 2J:
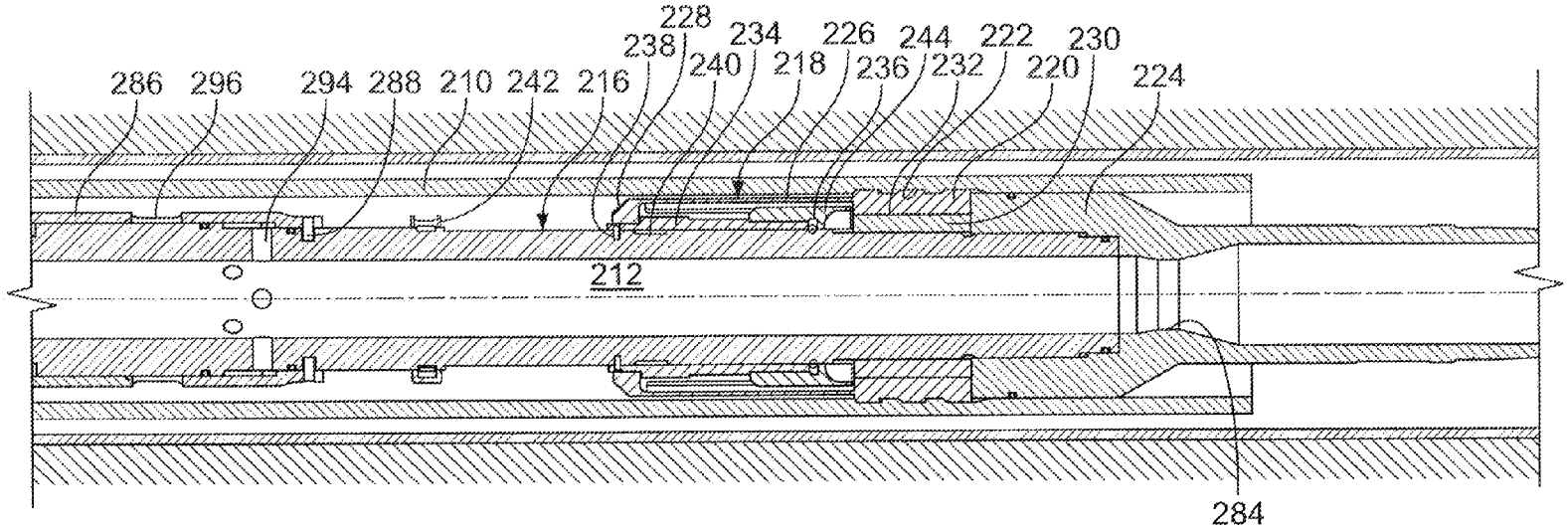

The lugs 220 and their operation are best understood with reference to FIG. 2J. The inner mandrel assembly 216 carries a latch assembly 218 having the plurality of circumferentially spaced lugs 220 residing at the ends of an equal number of radially flexible fingers 226 extending from a base ring 228. The lugs 220, when radially extended, engage corresponding female receptacles of mating profile 222 in the liner hanger 210. The lugs 220, when allowed to radially retract, disengage from the corresponding mating profile 222 in the liner hanger 210. The flexible fingers 226 bias the lugs 220 into the corresponding mating profile 222. The female receptacles in the mating profile 220 correspond in number to the number of lugs 220. In the present example, there are twelve lugs 220, but fewer or more can be provided.

Figure 6:
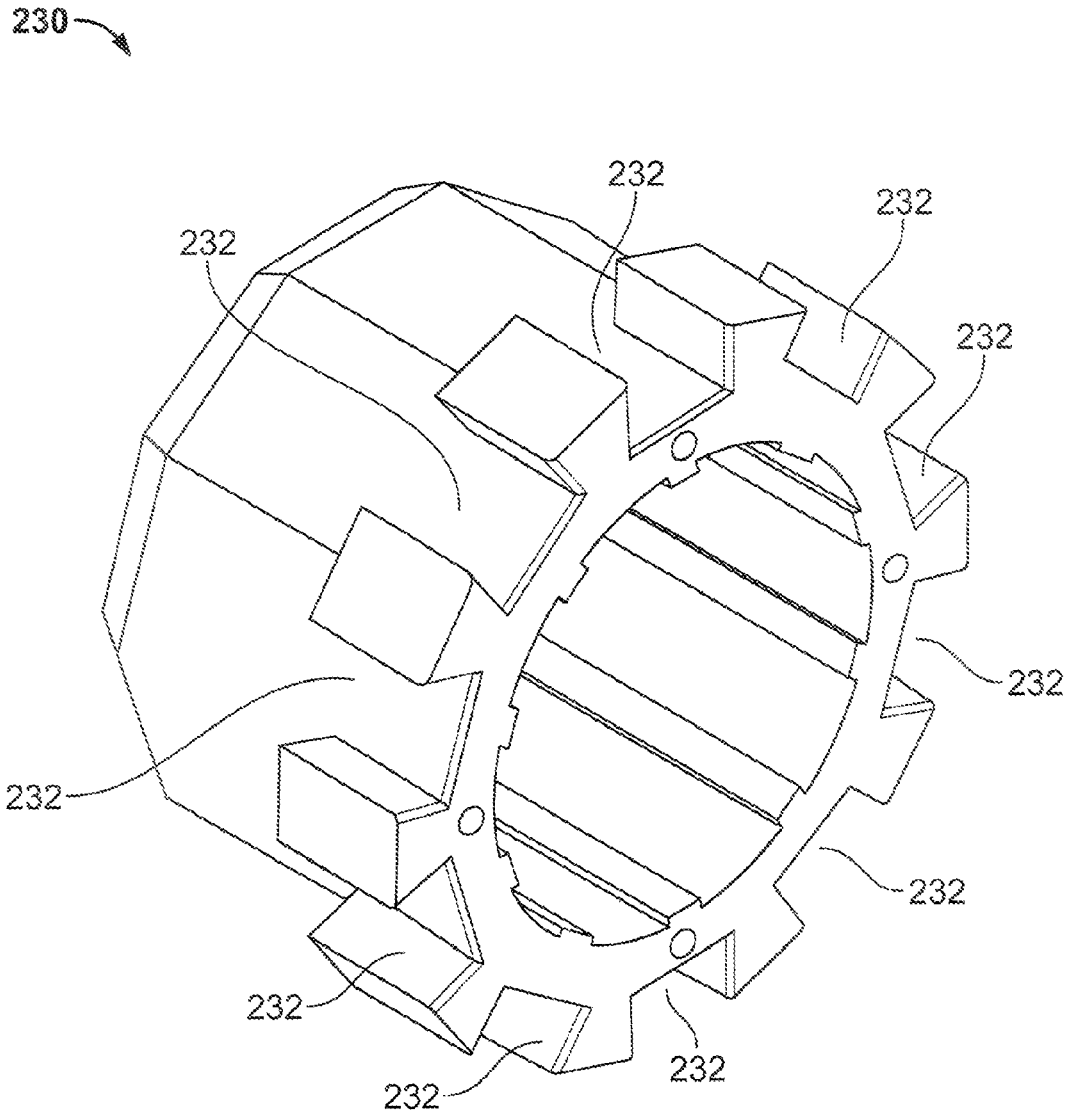
FIG. 6 is a perspective view of an example latch prop.

The lugs 220 are radially supported extended into engagement with the mating profile 222 via a latch prop 230. As shown in FIG. 6, the latch prop 230 has a plurality of U-shaped latch prop receptacles 232 into which the lugs 220 are received. The latch prop receptacles 232 correspond in number to the number of lugs 220. The receptacles 232 both radially support the lugs 220 in the extended state, as well as prevent circumferential movement between the lugs 220 and the latch prop 230. The latch prop 230 is keyed to the inner mandrel assembly 216 to prevent circumferential movement between the latch prop 230 and the inner mandrel assembly 216. Thus, torque applied through the setting tool 200 is transmitted to the liner hanger 210.

The latch prop 230 and lugs 220 abut a shoulder on the latch prop body 224, such that force on the liner hanger 210 towards the downhole end of the setting tool 200 (e.g., from the weight of the liner and the reaction force against the expansion cone 250 being driven downhole through the liner hanger 210) is supported by the latch prop body 224.

The lugs 220 are released to be able to radially retract out of engagement with the mating profile 222 of the liner hanger 210 by moving the latch prop 230 out of engagement with the lugs 220. The base ring 228 of the latch assembly 216 rests against a shoulder ring 234 that is coupled to the inner mandrel assembly 216 by a shear pin 238. When sufficient force is applied to the inner mandrel assembly 216, forcing the inner mandrel assembly 216 downhole relative to the liner hanger 210, the shear pin 238 shears and allows the inner mandrel assembly 216, the lower latch prop body 224 and latch prop 230 to shift downhole relative the latch assembly 218 and shoulder ring 234. In doing so, the latch prop 230 moves out of engagement with the lugs 220, and leaves the lugs 220 radially unsupported. The lugs 220 have a sloped uphole surface configured to radially retract the lugs 220 out of engagement with the mating profile 222 of the liner hanger 210 when the lugs are radially unsupported and moved uphole relative to the liner hanger 210. The lugs 220 have a square downhole surface configured to engage the mating profile 222 and supports load when loaded in a downhole direction relative to the liner hanger 210. Downhole movement of the inner mandrel assembly 216 is limited when the shoulder ring 234 abuts a shoulder 242 on the inner mandrel assembly 216. The downhole directed load on the inner mandrel assembly 216 is thus supported between the lugs 220 engaging the mating profile 222 and the shoulder 242. Thereafter, the lugs 220 are released from the mating profile 222, by withdrawing the setting tool 200 uphole.

The lugs 220 are prevented from shifting back downhole and re-engaging the latch prop 230 as the shifting tool 200 is withdrawn from the wellbore by a garter spring 236 that is stretched around the inner mandrel assembly 216. The garter spring 236 is captured between the shoulder ring 234 and a garter spring guide 244 that is coupled to the shoulder ring 234. Thus, as the inner mandrel assembly 216 moves downhole and the lugs 220 are desupported, a circumferential recess 240 on the inner mandrel assembly 216 moves under the garter spring 236 to receive the garter spring 236. The garter spring 236 thereafter engages the recess 240, and holds the shoulder ring 234 and latch assembly 218 to the inner mandrel assembly 216 with the lugs 220 out of engagement with the latch prop 230. With the garter spring 236 engaged in the recess 240, the latch assembly 218 does not slide downward to reengage the latch prop 230. Subsequently, the setting tool 200 can be withdrawn from the liner hanger 210, and the uphole movement of the inner mandrel assembly 216 does not reengage the lugs 220 with the latch prop 230. As will be described in more detail below, the setting tool 200 can release from the liner hanger 210 (i.e., the lugs 220 be desupported) with or with out operating the tool 200 to expand the liner hanger 210.

Figure 3H:
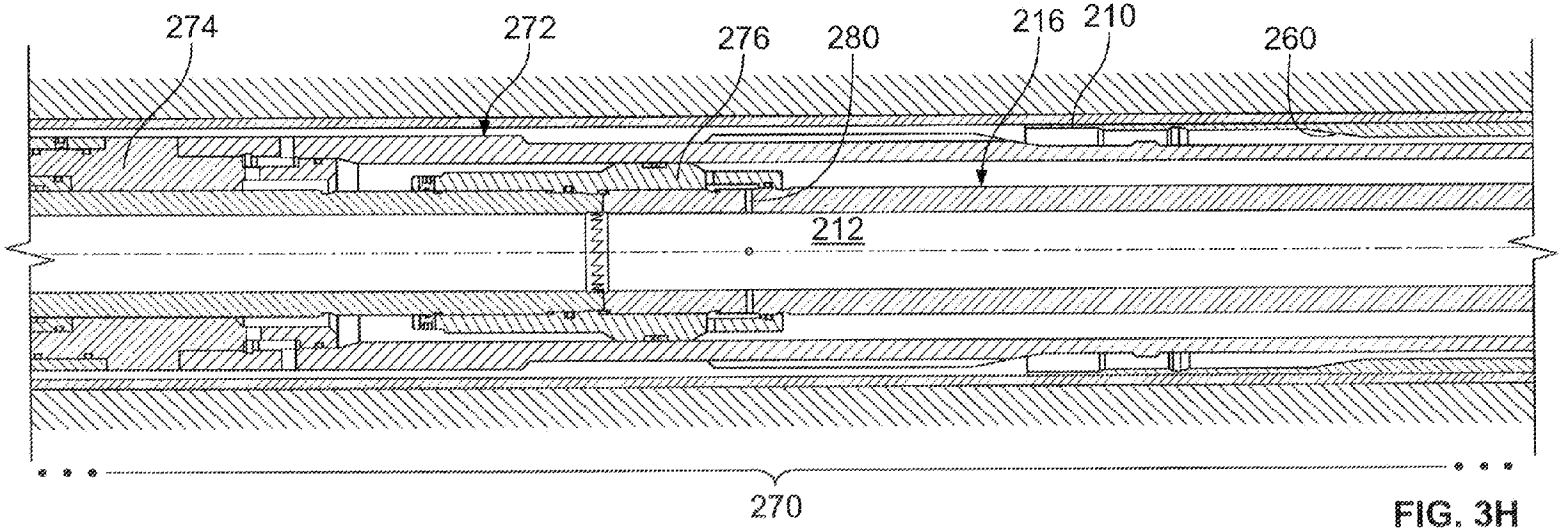
Figure 3I:
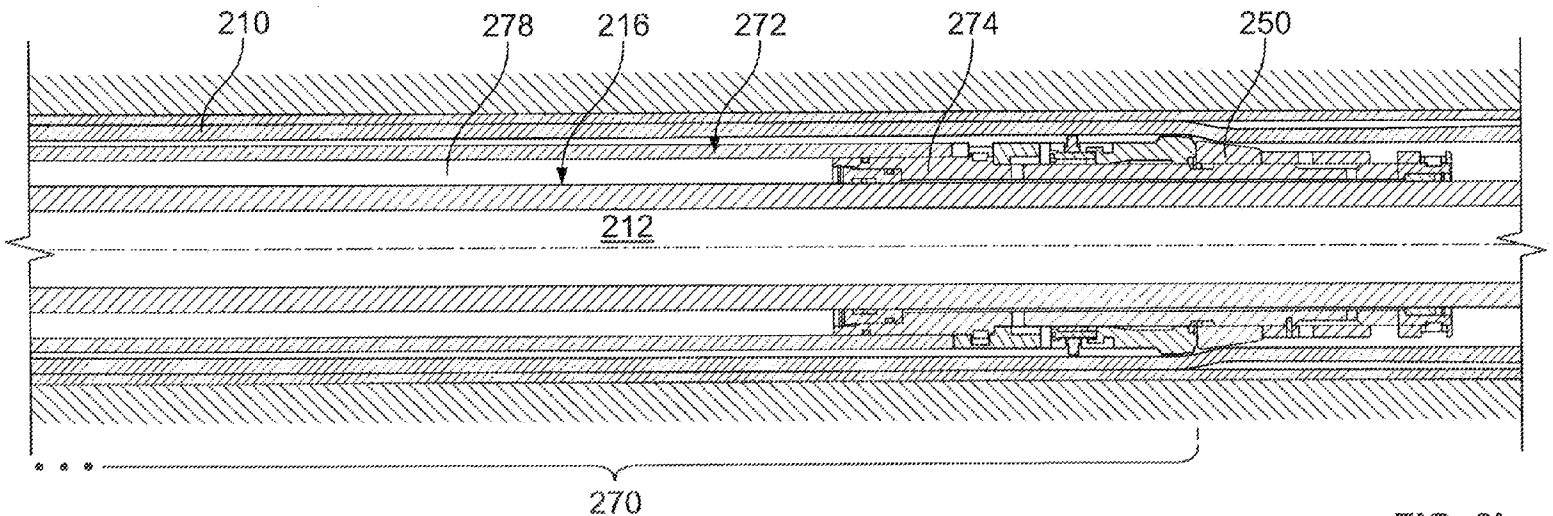

The expansion cone 250, shown in FIGS. 2H and 3I, is a frustoconical shaped element having a smallest outer diameter smaller than the inner diameter of the liner hanger 210, and a largest outer diameter larger than the inner diameter of the liner hanger 210. The expansion cone 250 is initially received in a cone launcher portion 260 of the liner hanger 210 (FIG. 2H), where the inner diameter of the liner hanger 210 is large enough to accept the expansion cone 250 without having been radially expanded. In this initial state, the liner hanger 210 is retained to the setting tool 200, pinched between the expansion cone 250 and the latching lugs 220. To expand the liner hanger 210, the expansion cone 250 is driven from the cone launcher portion 260 to a downhole position (FIG. 3I), through the liner hanger 210, by the expansion cone drive sub-assembly 270 shown over FIGS. 2B-2H and 3C-3I. As the expansion cone 250 passes through the liner hanger 210 it plastically, radially expands the liner hanger 210. In certain instances, the expansion cone 250 is sized to plastically, radially expand the liner hanger 210 such that the outer diameter of the liner hanger 210 is pressed into gripping and/or sealing engagement with the wall 290 of a wellbore (e.g. casing 292 or other). In certain instances, the liner hanger 210 can include one or more circumferential seals 212 (three shown) to facilitate achieving a liquid and/or gas tight seal with the wall 290 of the wellbore.

The expansion cone drive sub-assembly 270 includes an expansion cone driving sleeve assembly 272 that is coupled, about its downhole end, to the expansion cone 250 to drive the expansion cone 253 through the liner hanger 210. The uphole end of the driving sleeve assembly 272 abuts a support sleeve 256 that supports the driving sleeve assembly 272 against moving uphole relative to the inner mandrel assembly 216. The support sleeve 256 is affixed to the inner mandrel assembly 216 by dogs 258 that engage both the inner mandrel assembly 216 and the support sleeve 256.

The driving sleeve assembly 272, which may be made of multiple lengths of tubing, carries a plurality of axially spaced pistons 274 that seal against the inner mandrel assembly 216. In the configuration shown, the pistons 274 couple multiple lengths of tubing of the driving sleeve assembly 272 together. The expansion cone drive sub-assembly 270 further includes a plurality of axially spaced bulkheads 276 affixed to the inner mandrel assembly 216 and that seal against the interior of the driving sleeve assembly 272. The pistons 274, bulkheads 276, inner mandrel assembly 216 and driving sleeve assembly 272 cooperate to define a number of sealed hydraulic chambers 278 corresponding to the number of pistons 274 and bulkheads 276. Pressure applied in the hydraulic chambers 278 moves the driving sleeve assembly 272, and thus expansion cone 250, toward the lugs 220. The passages 280, at least one per hydraulic chamber 278, between the hydraulic chamber 278 and central bore 212 of the inner mandrel assembly 216 communicate pressure from the bore 212 of the inner mandrel assembly 216. The space between the driving sleeve assembly 272 and the inner mandrel assembly 216, opposite the hydraulic chambers 278, is ported to the outside of the driving sleeve assembly 272. In FIGS. 2B-2H, driving sleeve assembly 272 carries four pistons 274 and the inner mandrel assembly 216 carries four bulkheads 276. Thus, in FIGS. 2B-2H there are four hydraulic chambers 278. In other instances, fewer or more pistons 274 and bulkheads 276 can be provided to decrease or increase, respectively, the amount of force applied to the expansion cone 250.

Figure 3J:
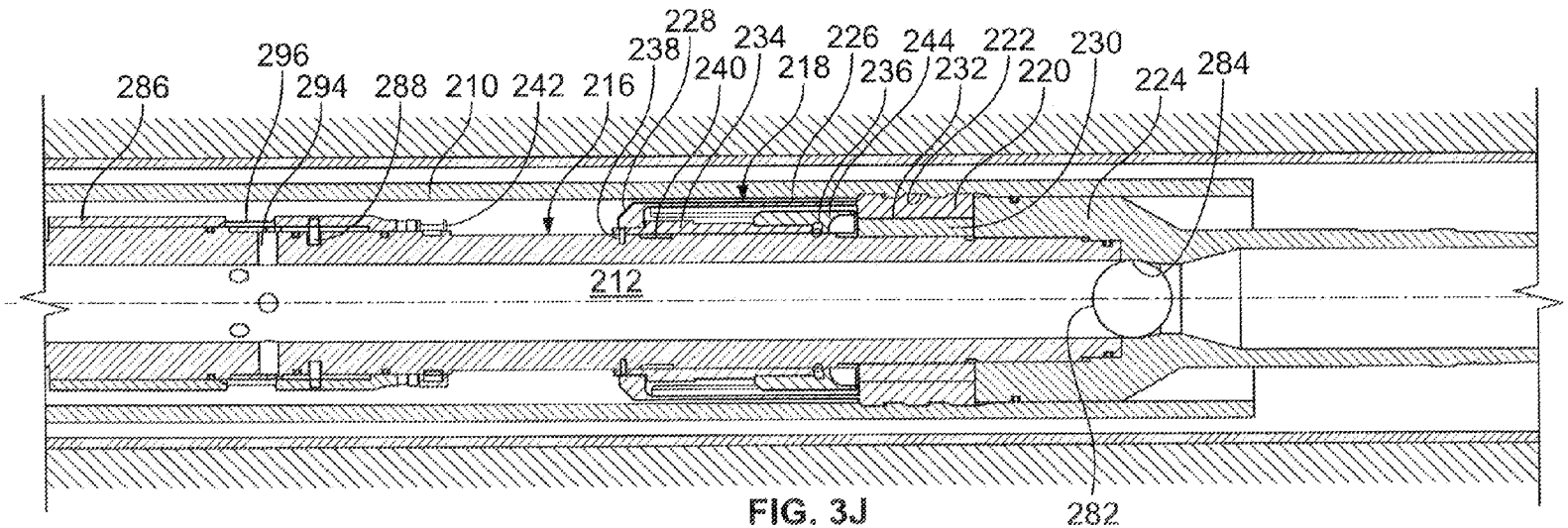
Figure 4:
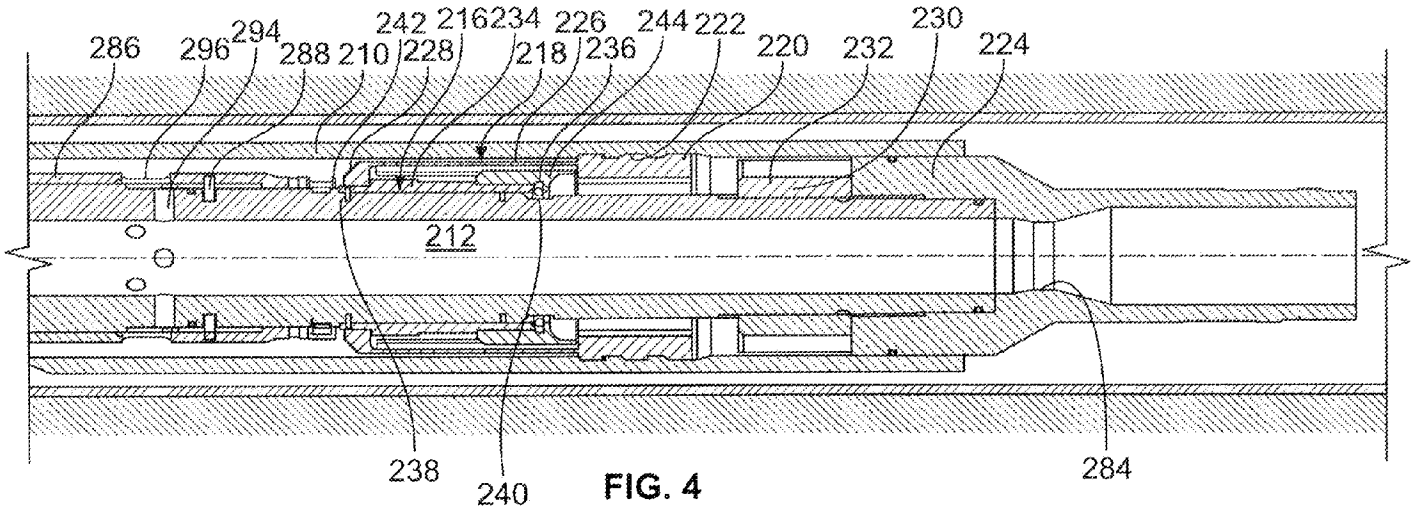
FIG. 4 is a cross-sectional view corresponding to FIG. 2J, but showing the lugs desupported to disengage from the liner hanger.

Normally, fluid can flow freely through the bore 212. As shown in FIG. 3J, the bore 212 has a constricted portion 284 of reduced interior diameter that can sealingly receive a plug 282, such as a spherical ball and/or other plug, to seal against passage of fluid flow downhole through the bore 212. To apply pressure to the hydraulic chambers 278, and thus actuate the expansion cone driving sub-assembly 270, the plug 282 is placed in the constricted portion 284, for example by being dropped and/or pumped from the terranean surface into the constricted portion 284. Thereafter, pressure applied through the bore 212 is communicated through the passages 280 into the hydraulic chambers 278. Enough fluid is provided to expand the hydraulic chambers 278, move the pistons 274 and driving sleeve assembly 272 downhole, to drive the expansion cone 250 through its full axial stroke. For example, compare the position of the pistons 274 in FIGS. 2C-2H to the position the same pistons 274 in FIGS. 3D-3I.

At the bottom of its stroke, the expansion cone driving sub-assembly 270 opens a bypass that allows flow in the bore 212 to bypass the hydraulic chambers 278, and thus cease operating the expansion cone driving sub-assembly 270 in moving the expansion cone 250. More specifically, referring to FIGS. 2J and 3J, as the expansion cone driving sub-assembly 270 reaches the bottom of its stroke, the expansion cone 250 impacts and shifts a bypass sleeve 286, carried on the inner mandrel assembly 216 uphole from the constricted portion 284. As seen in FIG. 2J, prior to being shifted by the expansion cone 250, the bypass sleeve 286 sealingly covers a plurality of bypass ports 294 of inner mandrel assembly 216 and seals against passage of fluids from the bore 212 out of the inner mandrel assembly 216. The bypass sleeve 286 is retained in this position sealingly covering the bypass ports 294 by shear pins 288. When the expansion cone 250 impacts the bypass sleeve 286, the shear pins 288 shear and the bypass sleeve 286 shifts downhole into contact with the lug 242. Thereafter, as shown in FIG. 3J, corresponding ports 296 on the bypass sleeve 286 align with the bypass ports 294 in the inner mandrel assembly 216 and allow flow from the bore 212 to flow of the inner mandrel assembly 216.

After expanding the liner hanger 210 (FIGS. 3H-3J), the setting tool 200 can be decoupled from the liner hanger 210 by applying a downward force to the inner mandrel assembly 216, shift the inner mandrel assembly 216 downhole relative to the liner hanger 210, and desupport the lugs 220 as described above. When desupported, the lugs 220 can retract inward and release from the mating profile 222 (thus releasing the setting tool 200 from the liner hanger 210) as the setting tool 200 is withdrawn, uphole, from the liner hanger and out of the wellbore.

The setting tool 200 can also release from the liner hanger 210 (i.e., the lugs 220 be desupported) without having operated the tool 200 to expand the liner hanger 210. For example, in the operation described above, the inner mandrel assembly 216 is discussed as fixed relative to an expansion cone drive sub-assembly 270. However, the setting tool 200 is changeable to partially release the inner mandrel assembly 216 from the expansion cone drive sub-assembly 270, so that the inner mandrel assembly 216 can be shifted downhole to desupport lugs 228 without operating the expansion cone drive sub-assembly 270.

To this end, referring to FIGS. 2A and 2B, the upper body 214 has an interior facing slot 246 that receives an outwardly protruding lug 248 of the inner mandrel assembly 216. The slot profile 246 is generally configured as an upside down "J," i.e. with hook portion of the J near the uphole end of the upper body 214 and the long portion of the J extending axially downhole therefrom. The J-slot 246 defines an upper receptacle 246*a* towards an uphole end and a lower receptacle 246*b* towards a downhole end. In normal operation of the setting tool 200, for example when the setting tool 200 is run into a wellbore, the lug 248 of the inner mandrel assembly 216 is received in the upper receptacle 246*a*. With the lug 248 in the upper receptacle 246*a*, the upper body 214 and the inner mandrel assembly 216 are retained so that the upper body 214 cannot move downhole relative to the inner mandrel assembly 216. However, rotating the upper body 214 counterclockwise dislodges the lug 248 from the upper receptacle 246*a* and allows the upper body 214 to move downhole relative to the inner mandrel assembly 216 and the lug 248 to traverse the remainder of the J-slot 246 and be received in the lower receptacle 246*b*.

When the upper body 214 moves downhole relative to the inner mandrel assembly 216, it releases the inner mandrel assembly 216 from the expansion cone drive sub-assembly 270. A support sleeve 256 supports the expansion cone drive sub-assembly 270 relative to the inner mandrel assembly 216. As the upper body 214 moves downhole, it contacts a release sleeve 252 and shears shear pins 254 retaining the release sleeve 252 to the support sleeve 256. The release sleeve 252 supports dogs 258 that engage the inner mandrel assembly 216 and affix the support sleeve 256 relative to the inner mandrel assembly 216. Thus, when desupported, the dogs 258 release from the inner mandrel assembly 216 and allow the support sleeve 256 to move relative to the inner mandrel assembly 216.

After the inner mandrel assembly 216 is released from the expansion cone drive sub-assembly 270, the upper body 214 acts upon the inner mandrel assembly 216 to drive the inner mandrel assembly 216 downhole relative to the liner hanger 210. Driving the inner mandrel assembly 216 downhole relative to the liner hanger 210 moves the latch prop 230 out of engagement with the lugs 220, and desupports the lugs 220 as described above. When desupported, the lugs 220 can retract inward and release from the mating profile 222 (thus releasing the setting tool 200 from the liner hanger 210) as the setting tool 200 is withdrawn, uphole, from the liner hanger and out of the wellbore.

Figure 5:
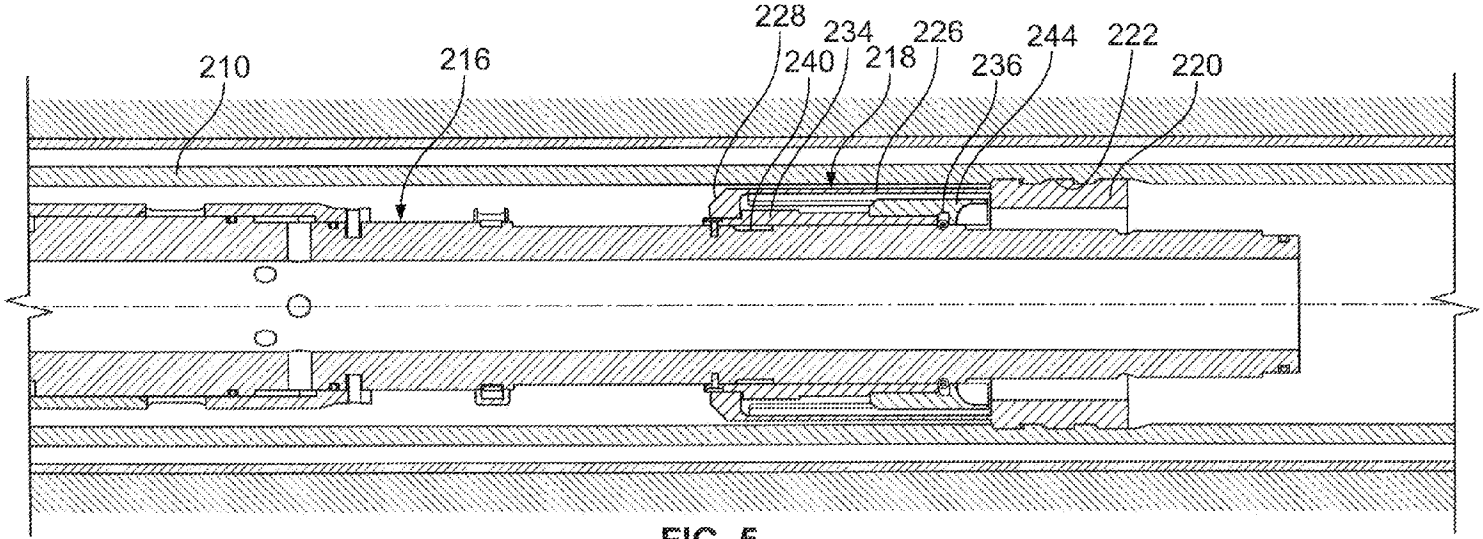
FIG. 5 is a cross-sectional view corresponding to FIG. 2J, but showing the latch prop body and latch prop removed from the inner mandrel assembly.

Prior to operation, the setting tool 200 is substantially assembled before assembly with the liner hanger 210 and the liner sub-assembly. Such assembly of the setting tool 200 and assembly of the liner hanger 210 to the setting tool 200 is performed outside of the wellbore, and typically in an assembly shop remote from the well. In certain instances, however, some or all of the assembly can be performed at the well site. To this end, the inner mandrel assembly 216, the expansion cone 250, expansion cone driving sub-assembly 270, the bypass sleeve 286, the support sleeve 256, the release sleeve 252, the upper lug body 214, and the latch assembly 218 are all assembled to the setting tool 200. The latch prop body 224 and the latch prop 230 are not assembled to the inner mandrel assembly 216, as shown in FIG. 5. In this state, the expansion cone 250 and expansion cone driving sub-assembly 270 are fully assembled, and can even be operated over a portion or the entirety of its stroke (e.g., for testing purposes) by plugging the bore 212 and applying pressure to the hydraulic chambers 278. Because the latch prop 230 is not assembled to the inner mandrel assembly 216, the lugs 224 can retract from the radially extended state. The liner hanger 210, thus, can be received over the setting tool 200 such that the expansion cone 250 is received in the cone launcher 260 of the liner hanger 210, and the lugs 220 of the latch assembly 218 are aligned axially with and loosely received in their mating profile 222. The latch prop 230 is then fitted to the inner mandrel assembly 216 to support the lugs 220 radially extended into locking engagement with the mating profile 222, and the latch prop body 224 is coupled to the inner mandrel assembly 216 to support the latch prop 230. Thereafter, any remaining small number of steps are performed to complete assembly of the setting tool 200.

Notably, in certain instances, the latch prop body 224 and latch prop 230 are able to be fitted to the inner mandrel assembly 216 through the bottom end of the liner hanger 210. Thus, the liner hanger 210 can be constructed as a single, unitary tubular member extending from end to end, and need not have provisions to be separated intermediate its ends (e.g., a threaded connection) to facilitate access to the latch assembly 218 or fitting the latch prop 230. In certain instances, a single piece, unitary liner hanger 210 is stronger and less expensive to manufacture than a liner hanger with provisions to be separated intermediate its ends.

Subsequently, if it is desired to access a portion of the setting tool 200 or otherwise decouple the expandable liner hanger 210 from the setting tool 200, the expandable liner hanger 210 can be easily decoupled from the setting tool 200, because the setting tool 200 was substantially assembled prior to coupling with the expandable liner hanger 210. Thus, the step of coupling the setting tool 200 with the expandable liner hanger 210 was the last or one of the last steps to have been performed, and the setting tool 200 need not be substantially disassembled. Such ease of removal and installation of the liner hanger 210 to the setting tool 200 enables the liner hanger 210 to be easily changed (e.g., for a liner hanger 210 of a different material, different configuration and/or different dimension) and/or enables easy access to the setting tool 200 to change or verify aspects of the setting tool 200. Because the expansion cone driving sub-assembly 270 and the remainder of the tool 200 remain in-tact and assembled, it is unnecessary to re-perform any testing or quality checks performed on the setting tool 200 before or when the liner hanger 210 was initially assembled to the setting tool 200.

To this end, to decouple the liner hanger 210 from the setting tool 200, the latch prop body 224 is decoupled from the inner mandrel assembly 216 and the latch prop 230 removed from the inner mandrel assembly 216. In certain instances, the latch prop body 224 and latch prop 230 are removed through the bottom end of the liner hanger 210 to desupport the lugs 220 while the expansion cone driving sub-assembly 270 and the remainder of the tool 200 remains substantially in-tact and assembled. Any frangible parts, such as the shear pins 238, 254 and 288, can remain in place and remain in-tact and not sheared. In certain instances, some minor additional operations can be performed. In certain instances, the only operations whatsoever needed to enable removal of the liner hanger 210 from the setting tool 200 are removal of the latch prop body 224 from the inner mandrel assembly and moving or removing the latch prop 230 to desupport the lugs 220.

With the lugs 220 desupported, the liner hanger 210 can be removed from the setting tool 200, by pulling the setting tool 200 axially out through the uphole end of the liner hanger 210 or by pulling the liner hanger 210 off the downhole end of the setting tool 200. Any changes, adjustments, or inspections can be made to the setting tool 200 and/or liner hanger 210, and the liner hanger 210 or another liner hanger 210 reinstalled as described above.

Notably, although described herein as involving removal of the latch prop 230 and latch prop body 224 to release the liner hanger 210 from the setting tool 200, the same effect can be achieved in a number of different manners consistent with the concepts described herein. For example, in certain instances, the setting tool can be configured such that the latch prop 230 is moveable to desupport the lugs 220 without removal of the latch prop body 224 or latch prop 230 from the inner mandrel 216.

A number of implementations have been described. Nevertheless, it will be understood that various modifications may be made. Accordingly, other implementations are within the scope of the following claims.

What is claimed is:

1. A method of decoupling a wellbore liner from a setting tool, the setting tool having an expansion cone drive sub-assembly operable to axially move an expansion cone of the setting tool through the liner to radially, plastically expand the liner, the method comprising:

with the wellbore liner residing outside of a wellbore, changing the setting tool to allow a liner latching member of the setting tool to move radially inward and enable decoupling the wellbore liner from the setting tool while leaving at least the expansion cone drive sub-assembly substantially assembled; and decoupling the setting tool from the wellbore liner.

2. The method of claim 1, wherein leaving the expansion cone driving sub-assembly comprises leaving a hydraulic chamber assembly, that is responsive to hydraulic pressure to axially drive the expansion cone, substantially in tact to the setting tool.

3. The method of claim 1, wherein the expansion cone driving sub-assembly of the setting tool is operable to axially move the expansion cone over its full axial travel when substantially assembled.

4. The method of claim 1, wherein changing the setting tool to enable decoupling the liner from the setting tool comprises disassembling a portion of the setting tool.

5. The method of claim 1, wherein the wellbore liner comprises a liner hanger and the setting tool is operable to radially, plastically expand at least a portion of the liner hanger.

6. The method of claim 1, wherein the wellbore liner is a single, unitary tubular member extending from end to end thereof.

7. A method of decoupling a wellbore liner from a setting tool, the setting tool having an expansion cone drive sub-assembly operable to axially move an expansion cone of the setting tool through the liner to radially, plastically expand the liner, the method comprising:

with the wellbore liner residing outside of a wellbore, changing the setting tool to enable decoupling the wellbore liner from the setting tool while leaving at least the expansion cone drive sub-assembly substantially assembled; and decoupling the setting tool from the wellbore liner, and wherein changing the setting tool to enable decoupling the setting tool from the liner comprises changing the setting tool to allow a liner latching member of the setting tool to move radially inward; and wherein changing the setting tool to enable decoupling the setting tool from the liner further comprises moving a propping member that supports the latching member in engagement with the liner.

8. The method of claim 7, wherein moving the propping member, comprises removing the propping member from the setting tool.

9. The method of claim 8, wherein removing the propping member from the setting tool comprises removing the propping member through a downhole end of the liner.

10. A method of assembling a wellbore liner to a setting tool, the setting tool for radially, plastically expanding the liner, the method comprising:

with an expansion cone of the setting tool, expansion cone drive sub-assembly of the setting tool and liner latching member of the setting tool assembled, assembling the wellbore liner to the setting tool; and radially extending the liner latching member into engagement with the wellbore liner to couple the wellbore liner to the setting tool.

11. The method of claim 10, wherein the expansion cone drive sub-assembly comprises a hydraulic assembly that is responsive to hydraulic pressure to drive the expansion cone axially through the liner when the wellbore liner is coupled to the setting tool, to radially, plastically expand the wellbore liner.

12. The method of claim 10, wherein engaging the liner latching member to the wellbore liner to couple the wellbore liner to the setting tool comprises moving a propping member of the setting tool to support the liner latching member radially extended into engagement with the wellbore liner.

13. The method of claim 12, wherein moving the propping member comprises assembling the propping member to the remainder of the setting tool.

14. The method of claim 13, further comprising, after engaging the liner latching member to the wellbore liner to couple the wellbore liner to the setting tool, completing assembly of the setting tool.

15. The method of claim 10, further comprising changing the setting tool to enable decoupling the wellbore liner from the setting tool while leaving the expansion cone of the setting tool, expansion cone drive sub-assembly of the setting tool and liner latching member of the setting tool assembled.

16. The method of claim 10, where radially extending the liner latching member into engagement with the wellbore liner comprises moving a propping member to support the latching member in engagement with the wellbore liner.

17. A setting tool for coupling to a wellbore liner and radially, plastically expanding the wellbore liner in a wellbore, the setting tool comprising:

a tubular mandrel;

a wellbore liner expander cone carried on the tubular mandrel and operable to radially, plastically expand the liner when moved axially through an interior of the wellbore liner;

an expander cone driving sub-assembly carried on the tubular mandrel and operable to axially move the expander cone axially through the wellbore liner to expand the wellbore liner; and a liner latching member carried on the tubular mandrel and changeable, with the setting tool residing outside of the wellbore, from latched and radially extended into engagement with the wellbore liner to unlatched and radially retracted from engagement with the wellbore liner without disassembling or operating the expander cone driving sub-assembly or disassembling the wellbore liner.

18. The setting tool of claim 17, wherein the liner latching member is changeable, with the setting tool residing outside of the wellbore, from unlatched to latched to the wellbore liner without disassembling or operating the expander cone driving sub-assembly.

19. The setting tool of claim 17, further comprising a liner latching member prop carried on the tubular mandrel that supports the liner latching member in engagement with the wellbore liner and is removable from the tubular mandrel without disassembling or operating the expander cone driving sub-assembly or disassembling the wellbore liner.

20. The setting tool of claim 17, wherein the wellbore liner is as a single, unitary tube extending from end to end thereof.

* * * * *